US007458527B2

(12) United States Patent
Lutzki

(10) Patent No.: US 7,458,527 B2
(45) Date of Patent: Dec. 2, 2008

(54) REVOLVING SPRINKLER

(75) Inventor: Moshe Lutzki, Kibbutz Gvat (IL)

(73) Assignee: Plastro Irrigation A.C.S. Ltd., Kibbutz Gvat (IL)

( * ) Notice: Subject to any disclaimer, the term of this patent is extended or adjusted under 35 U.S.C. 154(b) by 0 days.

(21) Appl. No.: 11/234,049

(22) Filed: Sep. 23, 2005

(65) Prior Publication Data

US 2006/0054716 A1 Mar. 16, 2006

Related U.S. Application Data

(63) Continuation of application No. PCT/IL2004/000269, filed on Mar. 24, 2004.

(30) Foreign Application Priority Data

Mar. 24, 2003 (IL) ..... 155053

(51) Int. Cl.
*B05B 3/02* (2006.01)

(52) U.S. Cl. ..... 239/230; 239/246; 239/258; 239/263; 239/252; 239/391; 239/394

(58) Field of Classification Search ..... 239/230, 239/240, 246, 391, 394, 222.13, 222.21, 239/252

See application file for complete search history.

(56) References Cited

U.S. PATENT DOCUMENTS 1,938,838 A * 12/1933 Jacobson ..... 239/236
2,574,874 A * 11/1951 Koeppel ..... 239/247
4,815,662 A * 3/1989 Hunter ..... 239/222.17
4,905,903 A 3/1990 Katzer et al.
5,307,993 A 5/1994 Simonetti et al.
5,421,517 A * 6/1995 Knudson et al. ..... 239/225.1
5,704,549 A 1/1998 Kephart et al.
5,746,374 A * 5/1998 Simonetti et al. ..... 239/240
6,085,995 A * 7/2000 Kah et al. ..... 239/237
6,499,672 B1 * 12/2002 Sesser ..... 239/222.11
6,899,285 B2 * 5/2005 Goettl et al. ..... 239/200

FOREIGN PATENT DOCUMENTS

EP 1 464 405 10/2004
GB 2 013 526 8/1979

OTHER PUBLICATIONS

Supplementary European Search Report for EP04722939, Aug. 6, 2008.

* cited by examiner

*Primary Examiner*—Dinh Q Nguyen
(74) *Attorney, Agent, or Firm*—Heslin Rothenberg Farley & Mesiti P.C.

(57) ABSTRACT

A revolving sprinkler comprises a rotatable turret assembly revolving around a rotation axis and formed with mouthpiece (s) suited to sprinkle liquid under pressure. The revolving sprinkler accommodates exchangeable mouthpieces with different throughputs-nozzle to rotation axis distance relationships, without changing a rotation velocity of the turret assembly.

36 Claims, 12 Drawing Sheets

REVOLVING SPRINKLER

CROSS REFERENCE TO RELATED APPLICATIONS

This application is a continuation of PCT International Application No. PCT/IL2004/000269 filed Mar. 24, 2004 and published in English as WO 2004/085077 A1 on Oct. 7, 2004 which claims priority of Israel application no. 155053 filed Mar. 24, 2003, the disclosures of which are hereby incorporated by reference herein in their entirety.

FIELD OF THE INVENTION

The present invention relates to the field of revolving sprinklers in general, and to those revolving sprinklers that are primarily intended for providing irrigation for cultivating agricultural areas in particular.

BACKGROUND OF THE INVENTION

Revolving sprinklers are widely used and very common for specific agricultural use as well as for wetting large areas, extinguishing fire, dish washers, etc. For the sake of simplicity, the background of the invention, as well as the description of the invention proper, will be described as they refer to the agricultural irrigation application. This should not be wrongly taken to imply that as meant to limit the current invention and the attending claims to be valid solely for the agricultural irrigation—which is used for clarity of the explanations and eliminating cumbersome additional examples.

Achieving an increase of the area covered by single sprinkler, would naturally reduce the quantity of equipment pieces needed for covering a given area, and thus lower equipment cost. A gained synergy effect is evident—the deployment of the equipment and its transfer to other areas is simpler and faster, as well as lowering current and special maintenance expenditures.

The need for- and yearning to- increase the effective distance unto which water is sprinkled by revolving sprinklers, resulted in producing slower revolving sprinklers whose water ejection jet patterns is slowed down, for example to 1-10 rpm.

As dictated by basic physics laws, the water flow exiting a revolving sprinkler is made of two velocity components—one in the tangential direction and the other in the radial one. Decreasing the rotation speed increases the component in the desired radial direction (while reducing the one in the tangential direction). Thus, decreasing the rotation speed results in a larger range—the radial component water jet gets sprinkled farther away.

Needless to say, that by reducing the rotation speeds an additional benefit will be gained—namely a decrease of the abrasion and wear of the sprinklers' dynamic components, which are given to increased wear at higher rotation speeds.

In the past, several mechanisms were employed in revolving sprinklers for reducing the rotation speed. A well-known example is the implementation of a slowing down mechanism based on a transmission of toothed wheels. Such a transmission is a relatively expensive one, as it requires many parts. These wheels are naturally sensitive and given to enhanced abrasion and wear, coupled with accumulation of dirt on them. Packing the toothed wheels in a sealed box, in order to prevent contact with the water (a contact that leads to accumulation of fur on them) and contact with other contaminating substances, leads to increased price. In any case it is not an adequate solution to the complexity of the system (profusion of parts and above-mentioned sensitivity to abrasion and wear).

Another example for slowing down mechanism is the implementation of a mechanism based on the resistance provided by viscous liquid (e.g., silicone oil), to movement of dynamic component items immersed in it. This resistance to movement is, in given geometrical conditions, proportional to the movement velocity of the immersed dynamic component. The braking force in the viscous liquid increases linearly with the movement velocity of the immersed dynamic component, so that at zero speed the viscous liquid exerts no resistance to movement, whereas at high speeds the viscous liquid exerts high braking resistance and slowing down of the immersed dynamic component. Outstanding advantages of the viscous damping mechanism are—the small number of parts implemented in its assembly; relying on relative movement between smooth surfaces located in close distance (with shearing forces evolved at their interface, within the viscous fluid) as compared to the abrasion and wear evolved in the case of the mechanical transmission, accompanies the locking up of the sprockets one in another; and a synergic additional advantage imparted by the viscous liquid that constitutes a lubricating agent preventing wear and abrasion.

The application of viscous damping mechanisms in revolving sprinklers is described, for example, in patents U.S. Pat. Nos. 3,415,258; 4,440,345; 4,932,590; U.S. RE 33,823 and U.S. Pat. No. 5,377,914.

In the structures described by above cited patents, the rotation velocity of the revolving sprinklers is dependent on the drive moment generated by the force of the water being ejected through a mouthpiece.

The above is correct whether one considers a sprinkler of the kind in which a water jet emerging from a static nozzle is thrown unto a stream deflecting component that rotates around a rotation axis (a "spinner" or a deflecting component—see for example the structures of the sprinklers described in patents U.S. Pat. No. 3,415,258 and U.S. RE 33,823), or a sprinkler in which there exists a rotateable turret that is installed with a mouthpiece or mouthpieces (at least one), from whose nozzle a water jet emerges, and it itself (the water jet) by the reaction force it generates, serves to generate a moment to drive the rotateable turret around a rotation axis (see for example patents U.S. Pat. Nos. 4,440,345 and 5,377,914).

Under the presented circumstances, just the change in throughput, namely passing from low throughput to high throughput and vice versa, varies the drive moment generated by the sprinkler. In any case, in the configurations of the sprinklers described in the above cited patents, the rotation velocity of the flowing water emerging from them would also be changed (combined with a variation of the water jetting range).

Worse than that, it was found that subjecting the viscous damping mechanism to varying driving moments, might cause, after a given time period, to a failure of the mechanism and to phenomena of free spin rather than controlled action of the rotating components (whether it will be the spinner or deflector upon which the water impacts, or the rotating nozzle from which the water emerges).

Another disadvantage found in some of the revolving sprinklers manufactured according to the above cited patents, is the absence of the ability to change the angle of the water emergence direction and suiting it to the needs of the farmer. For example, irrigating in an open area, requires at times a relative higher angle for achieving a maximal range. On the other hand, irrigating in a grove under the trees dictates the adaptation of a relative low elevation angle. Most of the sprinklers described by the above cited patents do not offer such a solution in any manner whatsoever akin to these example (see for example, patents number U.S. Pat. Nos. 3,415,258; 4,440,345; 4,932,590; U.S. RE 33,823).

An additional drawback is found, for example—in a mechanical structure based on a "bridge like" construction that forms a link between one end of the sprinkler to its other end (see for example said "bridge" structures described in cited patents U.S. RE 33,823 and U.S. Pat. No. 3,415,258). This "bridge" structure is located in the passage path of the revolving water jet. The collision of the water jet with the "bridge" clearly disrupts the flow and exposes the sprinkler structure to shocks and vibrations that harm its stability.

A further example of a drawback that will be found in several types of some sprinklers if manufactured by the methods given in above cited patents stems from the fact that the water jet has to "slam" on an intermediate component, a deflecting component that rotates around a rotation axis (spinner or deflector, see for example the structures of the sprinkles described in patents U.S. Pat. No. 3,415,258 and U.S. RE 33,823). Evidently, such a structure limits the range that would have been achieved by direct casting of the water jet stream through a nozzle.

One more drawback of those sprinklers is the absence of a solution for a problem associated with the blocking of a sprinkler's mouthpiece, except dismantling it and cleaning it separately. This is a familiar and non-relished maintenance chore known to every farmer and resulting, additionally, in extra labor and in long down periods of the sprinklers system.

Another drawback of the sprinklers being described, is the lack of a solution to the problem of water down flow (drain) from the water supply system's lines, through the sprinkler's body, after the sprinkling was completed and the main system valve at the head of the pipe line is closed. Closing the main valve of the water supply line feeding the revolving sprinkler results in loss of residual water left in the line and the sprinkler, by slowly oozing out of the line through the sprinkler's body. In addition, modem irrigation techniques calls for providing short irrigation pulses with short duration breaks between them, which means many time of opening and closing the main valve, loosing large quantities of expensive water and delays caused as the empty lines have to be refilled and pressure in the line brought up.

There are even more drawbacks to be found in the revolving sprinklers if they would be built in accordance with the methods offered by the patents that we kept quoting, and let us present just one more in conclusion—this is the absence of the "pop up" configuration in all the above (except for the revolving sprinklers built in accordance with patent U.S. Pat. No. 4.932,590—but also this one would not provide operational flexibility from the point of view water throughput quantities and the aspect of low angle water jet direction). The pop up structure is used for up-righting the rotating assembly from which the water is sprinkled, for operating above the surface when pressure builds up in the line, and for convergence of the system when the water pressure in the line diminishes.

SUMMARY OF THE INVENTION

In contrast to the above deficiencies, a revolving sprinkler that would be manufactured in accordance with the present invention, provides adequate solutions overcoming all the drawbacks that were presented and described above.

One aspect of a revolving sprinkler implemented in accordance with a preferred embodiment of the current invention, is that its water pattern rotates at a substantially constant speed regardless of the variations in water throughput.

Another aspect of the revolving sprinkler that will be constructed in accordance with a preferred embodiment of the present invention, is that due to the integral and common structure of the sprinkler, its price would be lower than that of the examples cited above, while at the same time it will be relatively simple to manufacture, and most important—the desired essentially constant slow rotation of the water pattern at a beneficial constant speed would be enabled.

Similarly to the first aspect discussed above, the rotation velocity of the water pattern shall remain low and not vary significantly due to variations in water throughput. In other words—when an area is being irrigated using a sprinkler built in accordance with the present invention, with say a throughput of 1,000 lit/hr as per the present invention, and then with 400 lit/hr throughput, the slow rotation velocity of the revolving water pattern will not change significantly.

A distributing person of revolving sprinklers as per the invention, or a farmer using it, would not need a "collection" of different revolving sprinklers, but rather as implemented by the present invention, and based on the same sprinkler structure, they will be able to install—overall—a whole variety of exchangeable mouthpieces. The mouthpieces would differ one from another in the aspect of being suited to different throughputs and water pattern configurations of the water jet exiting from them, while basically ensuring rotation at the desired constant low velocity.

In other words—the present invention promises to provide the user with more or less the same reduced rotation velocity of the water pattern, and this even if he chooses to vary the sprinkler's throughput (by exchanging mouthpieces).

The braking mechanism that is installed in the sprinkler as per preferred configuration of the invention, and constricts the rotation velocity of the water jet pattern has a fixed structure, dimensions and properties. Therefore, the sprinkler ability to pass from low throughputs to high throughputs or from high sprinkler throughputs to low ones without radically changing the sprinkler's slow rotation velocity, is achieved while simplifies the structure of the sprinkler and reduces its manufacturing costs.

Another aspect in sprinklers' manufacturing practices which is attained by preferred embodiment of the present invention, is that it should enable to obtain as large as possible water jet distance.

Yet another feature as discussed, is enablement of fast, efficient and convenient cleaning of the sprinkler's water exit nozzle.

Another feature, described in detail above, of the preferred embodiment of the sprinkler in accordance to this invention—is to prevent water down pour from the sprinkler, so that closing the main valve of the revolving sprinkler's water feed line shall not cause loss of the water remaining in the line and neither loss of pressure in it (the importance of these requirements was cited above). Thus, on reactivating the sprinkler there is a beneficial saving of water quantities that would have been required otherwise, as well eliminating time loss for re-establishing the pressure in the line. Due to one preferred embodiment of the invention, the pressure build up will be immediate, and concurrently the irrigation would start.

It was also explained why "pop up" availability is an aspect to be embedded in the sprinkler's construction—and this is practically achieved in yet another preferred embodiment of the present invention, which integrates the pop up mechanism into the sprinkler's structure.

In yet another preferred embodiment of the revolving sprinkler which is the subject matter of the current invention, the sprinkler includes a turret assembly, rotateable around an axis. The rotateable turret assembly can be linked with the flow of water under pressure (for example, with the water flow in the water supply line of the irrigation line. The rotateable turret assembly is designed with at least one mouthpiece that is suited to deliver the water under pressure at a predetermined (thus known) throughput for a given liquid pressure. The mouthpiece (one or more) is located at a linear distance away from the rotation axis of the assembly. By this arrangement, the out flow of liquid from the mouthpiece imparts a drive moment to the assembly that causes its rotation around the rotation axis.

In accordance with the present invention, the revolving sprinkler is characterized by its mouthpiece (mouthpieces—one at least, if several mouthpieces are installed in the sprinkler) that is (are) exchangeable with—(i.e., replaced by—) by another mouthpiece. A replacing mouthpiece has a different design than the one being replaced, in some points: first, from the aspect of the nozzle that establishes the throughput of the liquid exiting from it at the given liquid pressure; second—in regard to the aspect of the linear distance of the liquid outlet nozzle to the rotation axis of the turret assembly.

Thus, even after the first mouthpiece was replaced by another (a second mouthpiece), the driving moment that brings about the rotation of the turret assembly around its rotation axis remains essentially equal to the driving moment that was generated when the first mouthpiece was mounted in the assembly.

In yet another preferred embodiment of a sprinkler in accordance with the present invention, the sprinkler includes—in addition, a braking mechanism that is coupled to the rotateable turret for slowing down it rotation velocity.

In another preferred embodiment of the revolving sprinkler in accordance with the present invention, the mouthpiece (one at least) is designed with a nozzle that has an inlet opening coupled with the flow of the water that is under pressure and a flow outlet opening from the nozzle. This mouthpiece is also rotateable around a rotation axis for affecting selection of angle of elevation at which the water will exit the nozzle.

In another preferred embodiment of the revolving sprinkler in accordance with the present invention, the mouthpiece is also rotateable around a rotation axis within approximately 180° and that is, essentially, perpendicular to the direction of the nozzle. This design property enables, when necessary, to direct the outlet of the nozzle directly to the source of the flow of water under pressure, in order to apply self-flushing of the nozzle, and this without having to extract the mouthpiece from the sprinkler and also without having to shut off the supply of water to the sprinkler body, on the contrary: the flow of the water under pressure is exploited for said self flush of the nozzle.

In another preferred embodiment of the revolving sprinkler in accordance with the present invention, the braking mechanism that is applied in the sprinkler is of the viscous damping type of mechanism.

The damping mechanism includes: a rotating dynamic assembly that constitutes a part of the rotateable turret assembly, a static component that is located in a relatively adjacent positioning to the revolving dynamic assembly and demarcates with it an enclosed space as a sealed basin, and a viscous liquid inside said sealed basin that opposes the movement of the rotating dynamic assembly relative to the static component.

Thus, the rotation speed of the sprinkler's turret assembly remains essentially constant, a feature that is the result of the essentially fixed driving moment that is exerted on it, and it is maintained under all circumstances—whether if, as said, the first mouthpiece that suits a given selected throughput is mounted in it, or, alternatively—another (the second) mouthpiece that suits a different selected throughput is mounted. Thus, the sprinkler in accordance with the embodiment of this invention enables a choice of throughput rates and distances to be used, and it is obtained without having the rotation velocity of the turret assembly undergoing any significant change.

In another preferred embodiment of the revolving sprinkler in accordance with the present invention, the sprinkler includes, in addition, a "no drain check valve" device for preventing drainage of water through the sprinkler when the pressure decreases.

In another preferred embodiment of the revolving sprinkler in accordance with the present invention, the sprinkler includes, in addition, a pop up device for up-righting the rotateable turret assembly to provide operation conditions for sprinkling over the upper surface when the pressure in the feed line increases, and for converging the rotateable turret assembly to a storage mode under the surface when the pressure of the water feeding line diminishes.

All that, and even more. In a revolving sprinkler that will be in accordance with a preferred embodiment of the present invention, the invention features a general method for maintaining an essentially constant rotation velocity, and this—as said, even though throughput values vary within a wide range.

A method that includes the stage of imparting the capability of exchanging the mouthpiece (one at least) mounted in the sprinkler—by another, whose design differs from the first one, both from the aspect of the nozzle that establishes the throughput of the exiting water at the given existing pressure, and from the linear distance aspect (its distance from the rotation axis of the sprinkler).

Thus, even after the first mouthpiece is replaced by another ("the second"), the driving moment that causes the rotation of the rotateable turret assembly around its rotation axis remains essentially equal to the driving moment that was generated when the first mouthpiece was the one mounted.

BRIEF DESCRIPTION OF THE DRAWINGS

The present invention will be better understood and appreciated more fully from the following detailed description, taken in conjunction with the drawings, in which:

Drawing No. 1 constitutes a side view of a revolving sprinkler in accordance with one preferred embodiment of the present invention.

Figure 1:
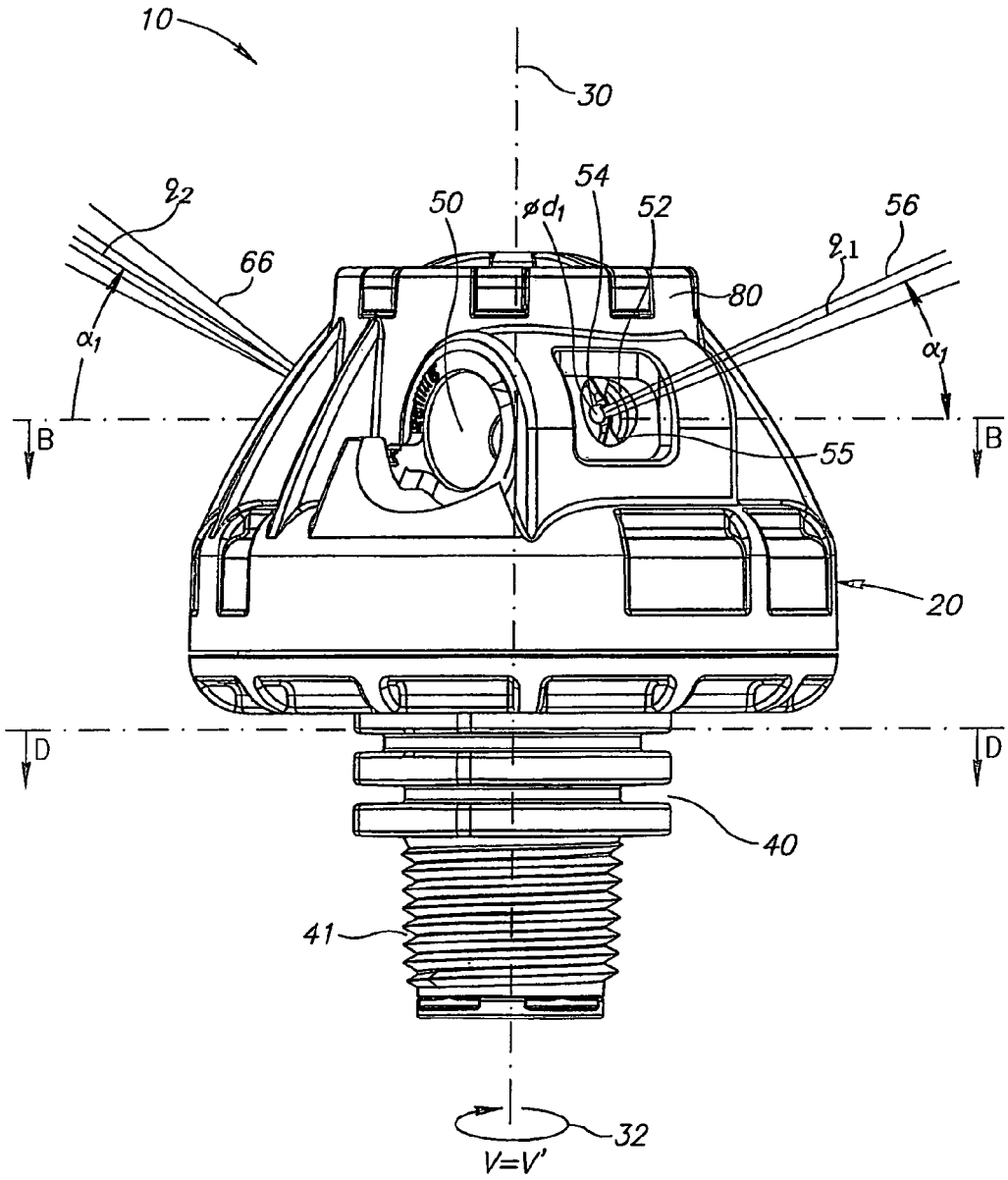

Drawing No. 2 presents a top view of the revolving sprinkler that was illustrated in drawing 1.

Drawing No. 3 constitutes a side cross section view of the revolving sprinkler that was illustrated in drawing 2, along the line marked A-A therein.

Drawing No. 4 presents an exploded view of the revolving sprinkler that was illustrated in drawings 1-3.

Drawing No. 5 constitutes a side cross section view of the revolving sprinkler that was illustrated in drawing 1, along the line marked B-B therein.

Drawing No. 6 includes two illustrations sequences (marked 6A and 6B, respectively). The first (6A) describes a "far" view (from a distance—for two different viewing angles), showing dismantling and reassembling procedure of a mouthpiece in the revolving sprinkler that was illustrated in drawings 1-5, the other (6B) depicts the same procedure in a close up view (for a single angle).

Drawing No. 7 constitutes an additional side view of the revolving sprinkler illustrated in drawing 2 along the line marked C-C therein, wherein in accordance with a given preferred embodiment of the present invention, the no-drain check valve device which is imbedded in the preferred embodiment that is shown in the drawing, is shown at its closed state (namely the no-drain mode).

Drawing No. 8 constitutes a side cross section view of the revolving sprinkler that was illustrated in drawing 7, wherein the no-drain check valve device is found at its open state (namely the state of sprinkling water by the sprinkler).

Drawing No. 9 constitutes an enlarged side cross section view of the preferred embodiment of the revolving sprinkler that was illustrated in drawing 1, along the line marked D-D therein.

Drawing No. 10 constitutes an additional side cross section view of an additional preferred embodiment in accordance with the present invention—depicting a sprinkler without the no-drain check valve device.

Drawing No. 11 constitutes a yet additional side cross section view of a preferred embodiment of a revolving sprinkler in accordance with the present invention—depicting a sprinkler with a pop up mechanism, wherein the drawing depicts, side by side, in one half a cross section view of the sprinkler at its operating state and in the other half cross section view it shows the sprinkler at its converged state.

DETAILED DESCRIPTION OF PREFERRED EMBODIMENTS

Note: In order to enhance clarity components that keep appearing in several drawings, are assigned identical part numbers.

Let's refer to drawings number 1 and 2. The drawings depict a side view and a top view, respectively, of a revolving sprinkler 10 in accordance with the preferred embodiment of this invention.

Sprinkler 10 comprises a turret assembly 20 that is rotateable around a fixed axis 30. The rotateable turret assembly 20 is coupled via base assembly 40—that constitutes the body of the sprinkler, with the flow of the water under pressure (the manner of this coupling will be explained when describing drawings 4 to 6).

An option for mounting the sprinkler 10 on a means for conveying the water flow under pressure, is for example, mounting the sprinkler 10 on a peg that is linked to an irrigating pipe (peg and pipe are not illustrated). Employing for that purpose external threading 41 that is formed on base assembly 40 and constitutes an integral part of it.

Any professional in the field would understand that, in regards to the manner of positioning a revolving sprinkler (as shown) and to the method of routing the water to it—the above presentation constitutes solely an example. The sprinklers may be deployed in a host of various ways and there is no need to present them in full detail herein under.

In the preferred configuration of the sprinkler 10 illustrated in the drawings, the sprinkler is shown with two mouthpieces, 50 and 60, respectively, that are installed in the turret assembly 20.

The mouthpieces are suited to sprinkle the water under pressure unto the area around the sprinkler without having the water jet bump into any obstacle in its route that results from the construction of the sprinkler. In other words, the specific configuration of sprinkler 10 consists of a sprinkler devoid of any "bridge" component. Simultaneously, any professional in this field would understand that the present invention, in the configuration described above, can also be implemented in revolving sprinklers that include a "bridge" structure.

Each of the two mouthpieces 50, 60, is designed with its nozzle 52 and 62, respectively, that incorporates a flow outlet 54 and 64, respectively, through which the water exits outwards.

Any professional in this field would understand, that the outlet of the flow from the nozzle of each of the mouthpieces, has a given geometrical structure and pattern that might result from mouthpiece and nozzle specific design, namely a cross section that necessarily influences the throughput of the water exiting it. Moreover, the flow outlet from the nozzle might be of a specific designed pattern that will shape the pattern of the water leaving it. Shapes might be as an integral jet, or "fog" droplets, "horse tail" shaped stream and so on. For example, it can be discerned that "teeth" like pattern 55 appears at outlet 54 that serve to form the exiting flow pattern. In contradistinction, at outlet 64 no "teeth" are embedded for shaping the flow pattern of the exiting water. Note that an important additional feature of the sprinkler 10 that would be constructed in accordance with the invention is derived—namely a sprinkler with two mouthpieces as depicted by the illustrated sprinkler 10—resulting in the ability to impart a specific and different shape to each of the water jets exiting it—and thus provide beneficial different irrigation patterns.

In order to execute the calculations detailed herein under, and for the sake of simplicity, an equivalent diameter of the flow output from a nozzle is calculated by considering its whole cross section area, taken as just a round nozzle. The equivalent diameter of flow outlet 54 will be calculated and assigned designation d1 and the equivalent diameter of flow outlet 64 will be calculated and assigned designation d2.

In the specific configuration of sprinkler 10 in which specific mouthpieces 50 and 60 are installed, each of the nozzles is suited to provide different water throughputs under the prevailing water pressure conditions reaching the sprinkler.

For example, in sprinkler 10, the flow outlet 54 of mouthpiece 50 is made for delivering a relatively low throughput at the given water pressure (and compare the graphical emphasis given to this point by using a few lines to represent the water outward jet stream, marked 56). The throughput from flow outlet 54 will be denoted q1.

On the other hand, the flow outlet 64 of mouthpiece 60 is made to deliver a high throughput at its given water pressure (and compare the graphical emphasis given to this point by using many lines to represent its outward water jet stream, marked 66). The throughput from flow outlet 64 is denoted q2.

It is needless to point out, that any professional in this field would understand, that in a revolving sprinkler formed in accordance with the preferred embodiment of this invention, one could also use a mouthpieces whose nozzles are identical (one with its mate), hence providing equal throughputs from them. It is also straightforward and understandable, that in a revolving sprinkler in accordance with this invention, only one mouthpiece might be installed with a single nozzle, or several nozzles one alongside the others, identical or differing one from the other, as well as more than two mouthpieces, each one with one nozzle or more, identical or differing one from the other.

The water outflow from each of the nozzles exits at specific given elevation angles—the water jet 56 leaves at elevation angle $\alpha$1, and the water jet 66 leaves at elevation angle $\alpha$2.

Figure 2:
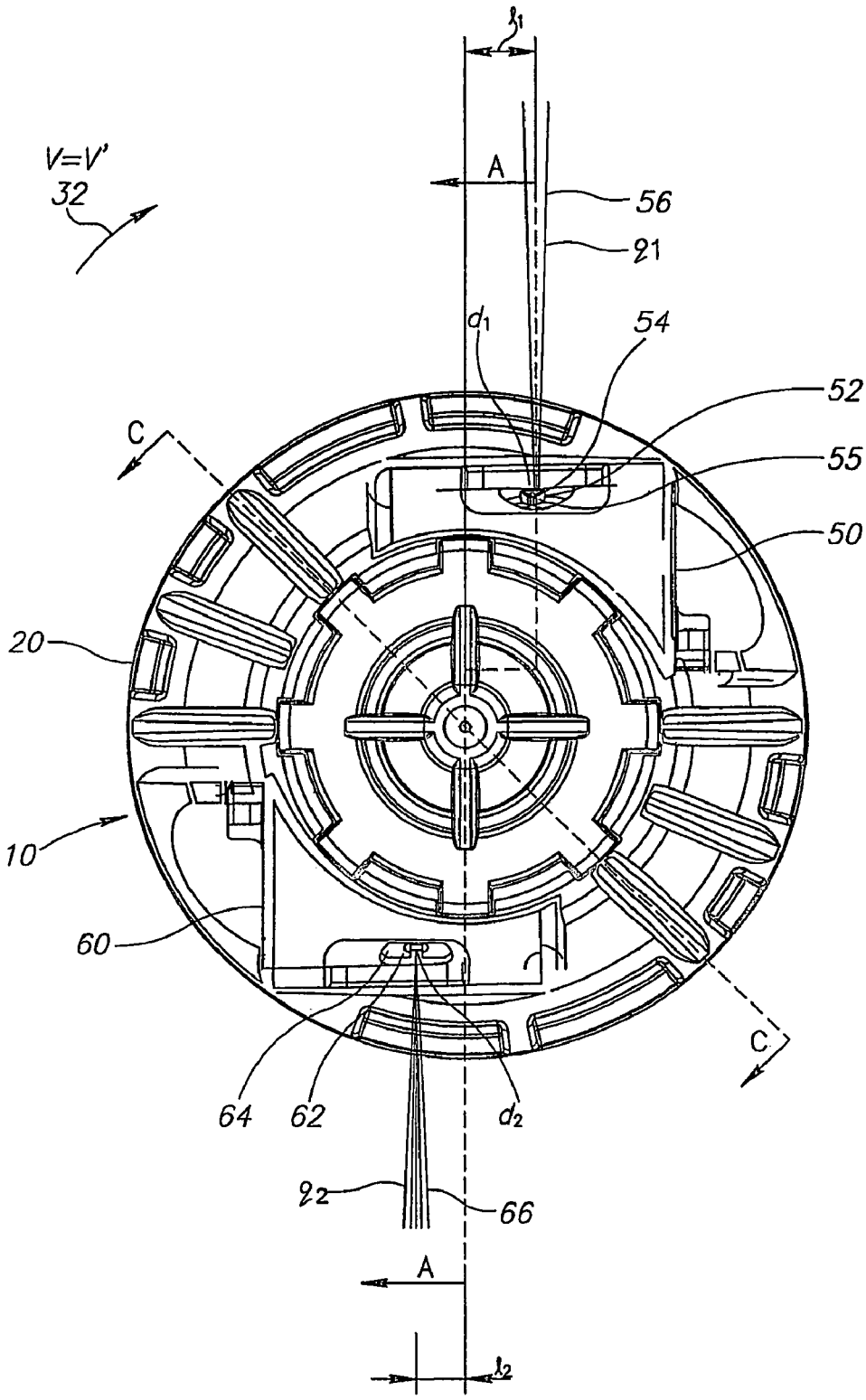
Figure 3:
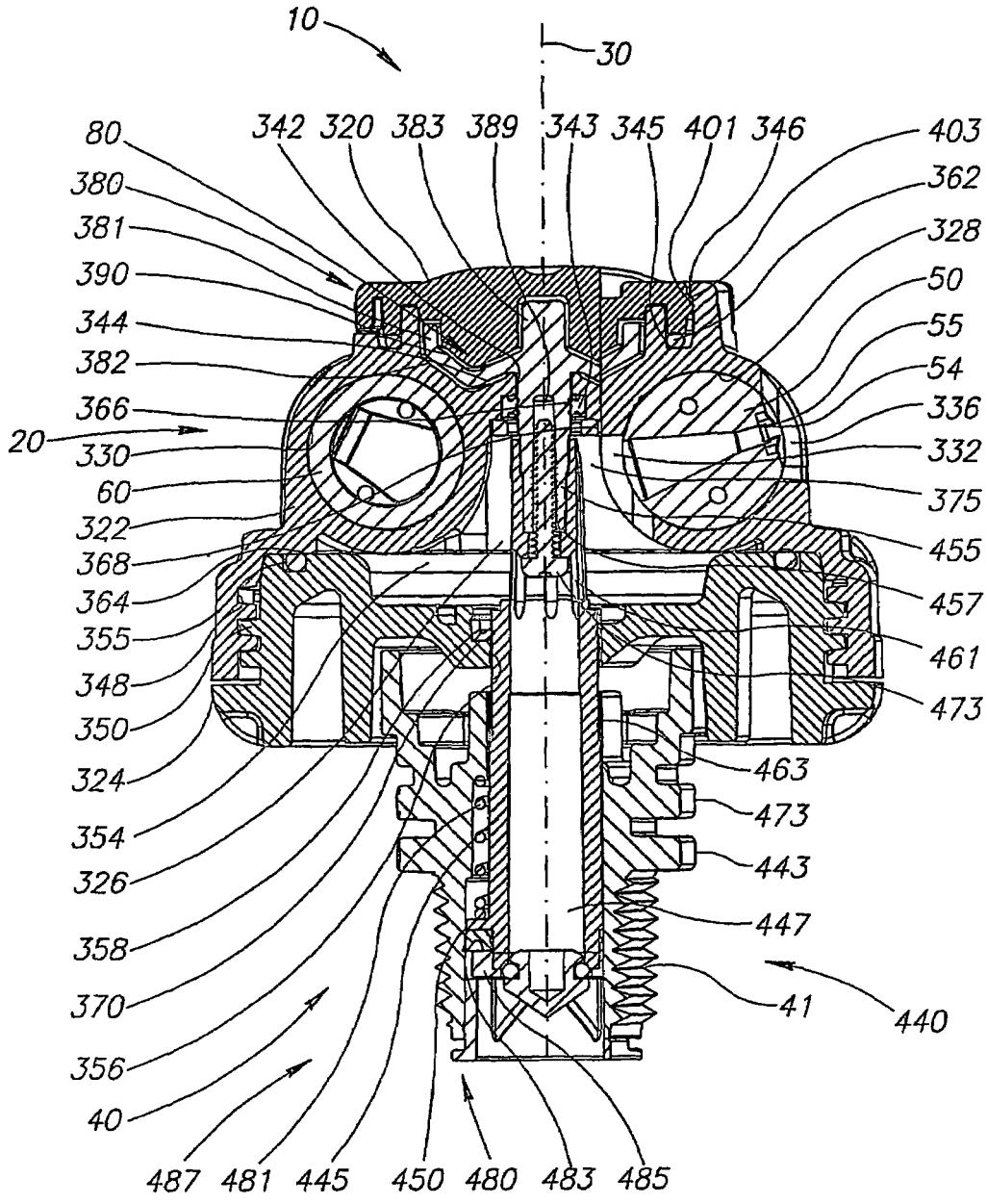
Figure 4:
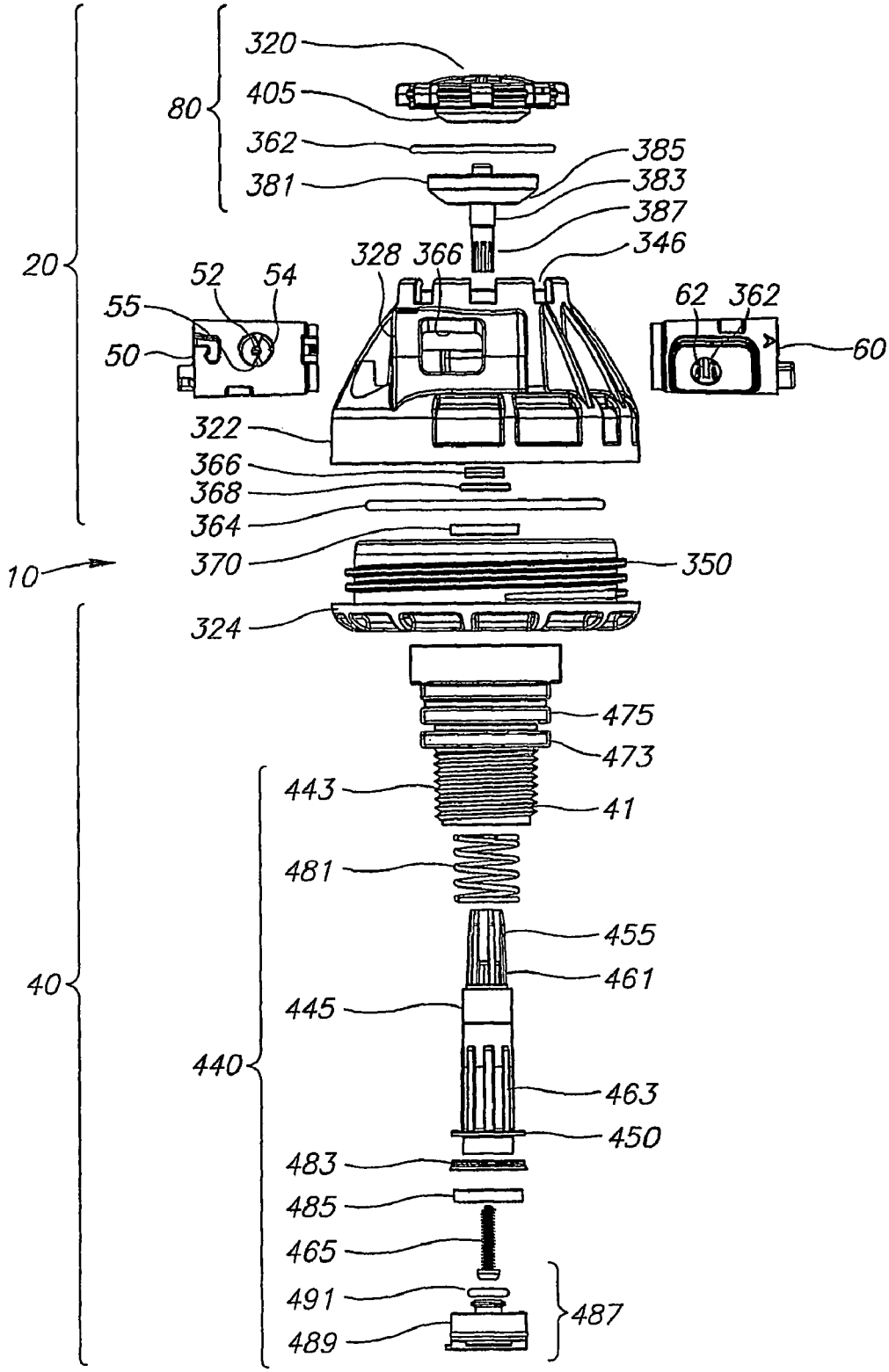
Figure 5:
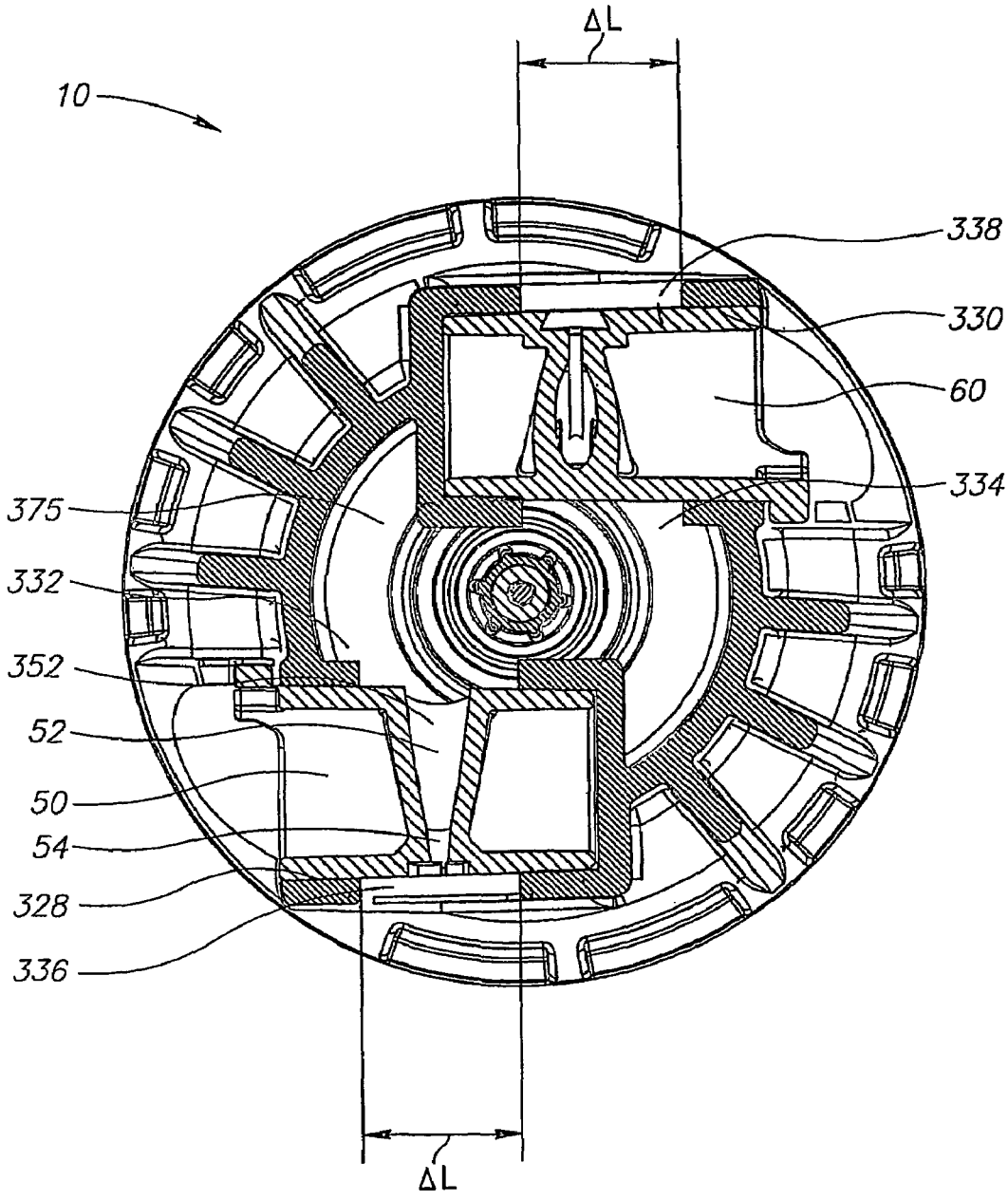

In sprinkler 10, the pair of flow outlets from the mouthpieces, are located—each one of them—on the other side of the rotation axis 30, and at different linear distances from this rotation axis 30 (see 11 and 12 respectively, FIG. 2).

For our discussion, the relevant linear distances as will be explained herein after, are measure by the distance from the imaginary perpendicular line at which the rotation axis 30 penetrates the virtual plane on which the flow outlet from the mouthpiece is located, to the operating component on said plane—for the water flowing from the flow outlet.

Referring to drawing number 2, the flow outlet 54 is located at a distance marked 11 from the rotation axis 30, and flow outlet 64 is located at the linear distance that is marked 12.

In the specific example illustrated in drawings 1 and 2 the mouthpiece (from the two) that is set for the higher throughput (mouthpiece 60 whose throughput is q2) is located—in its mounting to the sprinkler, so that the water outlet from its nozzle is placed at a distance 12; this linear distance being shorter than 11 which is the one set for its mate, namely the other mouthpiece of the same installation (mouthpiece 50) that is set for lower throughput q1.

In view of the above and what is shown in the drawings, any professional in this field would understand that sprinkler 10 is a revolving sprinkler of the kind whose water jet patterns create reaction force that causes their rotation. The force of reaction to the water flow outwards from the outlet of the mouthpiece nozzle constitutes a force that act on the turret assembly 20 to turn it around the fixed rotation axis 30. At the embodied configuration of sprinkler 10, this rotation is in the clockwise direction, as shown by arrow 32.

The moment of the force around the fixed axis 30 is equal to the product of the force times its moment arm—which is the discussed above linear distance. In other words, the driving force exerted on sprinkler 10 stems from the moment that is generated by the exit of the water from the two different sprinkling mouthpieces, at different angles and at pre determined throughput by the given liquid pressure.

An approximate calculation of the driving moment exerted by a water jet is carried out using the following general equation:

$$T = \frac{\rho \times L \times Q^2 \times \mathrm{COS}\alpha}{\Pi \times D^2}$$

Where:

T=driving moment;

ρ=density of the specific liquid;

L=linear distance;

Q=throughput;

α=Elevation angle, and

D=equivalent diameter of the flow outlet (the nozzle).

If we refer once more to drawings number 1 and 2, it is possible to understand the application of the "constant conservation of the driving moment" as it applies to-, and is used for- the basis for the present invention.

For the specific sprinkler 10 illustrated configuration, "the distance" L (or 11 and 12) that is significant for our calculation, is the distance from the operation point of the water jet as it exits the flow outlet of the nozzle, along a perpendicular line—to the point at which the rotation axis 30 penetrates the above mentioned virtual plane in which the force of reaction generated by the water flow over the plane is operating. This distance varies in accordance with the values of the throughputs from the different mouthpieces.

Any professional in this field would understand that from the mathematical point of view, it is possible to achieve, approximately, equality of the driving moment obtained from the pair of mouthpieces 50 and 60, if installed in sprinkler 10, and this provided a variable calibration of the linear distances 11 and 12.

Let us assume that instead of the pair of mouthpieces 50 and 60 installed in sprinkler 10, a different pair of mouthpieces 50' and 60' (not shown in the drawings) would have been installed. The equivalent diameters of the flow outlets from their nozzles are, respectively, D1 and D2. The outlets of the two flows are now adapted to throughputs Q1 and Q2. The water jets exit from them at the elevation angles α'1 and α'2, and the respective linear distances will be denoted L1 and L2.

Then, if we apply the general equation given above in order to obtain, approximately, an equality of the moments of driving, as said, the following equality holds:

$$T = \frac{\rho \times l1 \times q1^2 \times \mathrm{COS}\alpha 1}{\Pi \times d1^2} + \frac{\rho \times l2 \times q2^2 \times \mathrm{COS}\alpha 2}{\Pi \times d2^2} = \frac{\rho \times L1 \times Q1^2 \times \mathrm{COS}\alpha' 1}{\Pi \times D1^2} + \frac{\rho \times L2 \times Q2^2 \times \mathrm{COS}\alpha' 2}{\Pi \times D2^2}$$

Where:

T is the driving force that tends to turn the turret assembly 20 of sprinkler 10, and the rest of the entities are known or straightforward understandable.

Any professional in this field would understand that a dominant variable that influences the driving moment is the linear distance L which we defined above, namely the distance from the flow outlet of the mouthpiece's nozzle to the rotation axis. From this it is derived that when a change in linear distance L is feasible, it will be possible to adjust this distance in accordance with the throughput Q of the specific mouthpiece, and by this—maintain, approximately—the constant driving moment of the sprinkler.

The elevation angle α is not a dominant factor, and hence it is possible to obtain the characteristic of conservation of the driving moment as essentially constant in principle, even without considering the variations of the elevation angles (if such changes are enabled). For agricultural field sprinklers, it was found that in most cases, the angle of sprinkling the required water jet, has values between 0 to 30 degrees, hence in any case, the influence of variations in angle on the force component that tend to turn the turret assembly 20 is negligible.

From structural aspect, and referring to the specific sprinkler 10 that is described, as stressed previously—only for the sake of presenting an example, the sprinkler is characterized by that the two mouthpieces 50 and 60 are replaceable by at least another pair of mouthpieces, namely the pair of mouthpieces 50' and 60' (not illustrated in the drawings).

Mouthpieces 50' and 60' differ in their construction from mouthpieces 50 and 60, both from the aspect of the nozzles that establishes the throughput of the liquid that they emit at a given water pressure as well as from the aspect of linear distances (explained above) that exist between the water outlet nozzle in each of them to the rotation axis 30 of the turret assembly 30.

As per the invention, it is possible for example, to exchange the mouthpieces pair 50 and 60 by the pair of mouthpieces 50' and 60', without essentially varying at all the driving moment T that would be exerted on the rotateable turret assembly 20 at a given water pressure value. Thus, even after replacing mouthpieces 50 and 60 by mouthpieces 50' and 60', the driving moment T that brings about the rotation of rotateable turret assembly 20 around its rotation axis 30, remains essentially equal to the driving moment that was generated when the first pair of mouthpieces 50 and 60 were mounted in the rotateable turret assembly 20.

Any professional in this field would understand that the availability of mouthpieces that might be installed in accordance with the preferred configuration of this invention is not limited to a single pair of mouthpieces. It is possible to market a variety of pairs of mouthpieces that would differ from one another in the aspect of the nozzle that establishes the water throughput Q that is sprinkled in accordance with a given water pressure, and also differ in their linear distance L from the rotation axis of the sprinkler, provided only that the installation of another pair of mouthpieces shall not change significantly the driving moment T.

A similar consideration applies to a sprinkler with a single mouthpiece constructed in accordance with the invention, namely that it will be feasible to install a whole variety of single mouthpieces, and to a sprinkler of three mouthpieces configuration, that all are amenable to be replaced by others, and so on. Clearly, it is possible to implement the invention also in sprinklers accommodating multi mouthpieces, wherein only one or some of them are exchangeable.

Considering all the above given information, it is evident that any professional in this field would understand that we did verily present a comprehensive, general method for maintaining the rotation velocity of a revolving sprinkler essentially constant, and this also for cases where the throughput varies even between large limits. This method is applicable for sprinklers of the type in which a rotateable turret assembly is coupled with a liquid flow under pressure, and designed with at least one mouthpiece that is made for sprinkling the liquid which is under pressure at a known in advance throughput for a given pressure. In essence, it can be said that the principle of the method is the idea of imparting the capability to have a mouthpieces exchanged by another mouthpiece, wherein even after the mouthpieces were exchanged, the driving moment that brings about the rotation of the turret assembly around its rotation axis remains essentially equal to the driving moment that was active when the former mouthpiece was mounted in the assembly, thus maintaining the desired (and essentially equal) rotation velocity.

In one preferred embodiment of the present invention, the sprinklers in which the method that is the subject matter of this invention is implemented, are sprinklers whose rotation velocity is slowed down. Moreover, any professional in this field would understand that a braking mechanism can be coupled to the rotateable turret assembly, for slowing down its rotation velocity in relation to the driving moment exerted on it.

Thus, also inside the structure of sprinkler 10, a braking mechanism 80 is installed, whose possible structure would be described later on, when referring to drawings 2 and 3. The braking mechanism that is installed in sprinkler 10, is an integral single mechanism, namely, the same braking mechanism 80 is activated when there are mouthpieces 50 and 60 installed, as well as when a pair of alternate mouthpieces 50' and 60' are installed (not shown in the drawings).

Braking mechanism 80 is coupled to the rotateable turret assembly 20 for slowing down its rotation velocity around rotation axis 30. Because the same braking mechanism is referred to, and in both cases, the mechanism operates against the same and one driving moment T. Thus, it is immediately evident to any professional in this field, that the revolving velocity of sprinkler 10 when the pair of mouthpieces 50 and 60 are installed, this velocity that we designated V, would be essentially identical to the revolving velocity V' obtained by the system after the mouthpieces pair 50' and 60' (not illustrated) were installed.

The implementation of the invention in a revolving sprinkler with reduced revolving velocity, enables to vary the throughputs that are sprinkled by the sprinkler, without significantly varying the velocity of the water pattern rotation. Thus, by using a revolving sprinkler constructed in accordance with this invention, it is possible to get the most of the range advantage that is obtained as a result of the slow rotation of the water pattern, and all this without having to change the construction of the braking mechanism.

The variety of mouthpieces that can be mounted on a revolving sprinkler embodied according to the invention enables optimal planning of pattern selection for covering the area. Any professional in this field would understand that by resorting to different mouthpieces it is possible to obtain optimization of the sprinkling under varying conditions and ranges, and to shape water jets for the different ranges around the sprinkler.

Thus, for example, in experiments carried out with a revolving sprinkler of the type illustrated in the drawings, namely a revolving sprinkler with a pair of mouthpieces, each one exchangeable separately, a throughput of 400 lit/hr was achieved, in a configuration in which one mouthpiece delivered 240 lit/hr and its mate delivered 160 lit//hr. The two mouthpieces were removed from the sprinkler and two other mouthpieces were installed instead. For this case a throughput of 800 lit/hr was achieved, with one mouthpiece delivering 500 lit/sec and the other one 300 lit/sec. The water jets rotated in the two configurations, essentially at equal speeds and this as a result of the various linear distances that existed in the various mouthpieces. Wherein the viscous mechanism type of braking mechanism that was installed in the sprinkler, was loaded —in both of the two cases, essentially to the same driving moment.

Let's refer now to drawings number 3 and 4. Drawing No. 3 is a side cross section view of revolving sprinkler 10 that is illustrated in drawing 2, along the line marked A-A there. This drawing enables one to comprehend the mode of integrating the various components making up sprinkler 10. The structure of each one of these components is also shown in drawing 4 (the exploded view of sprinkler 10 components), which helps to understand them even better.

As said, sprinkler 10 includes three major assemblies—the rotateable turret assembly 20 that rotates around axis 30 (see drawings 1 and 2), the braking mechanism 80 that is coupled to the rotateable turret assembly 20 for reducing its speed and the base assembly 40.

The rotateable turret assembly 20 includes a cover component 20, upper turret component 322 and lower turret component 324.

The upper turret component 322 is constructed as housing with inner space 326, partly open at its lower part. Two hollow cylindrical brackets 328 and 330 are mounted over the outer surface of the upper turret component 322. Each of these two brackets is formed essentially as a cylindrical bore extending in a direction essentially perpendicular to the rotation axis 30 and located over a plane whose direction is perpendicular to the rotation axis 30. Each of said brackets is positioned on opposing sides of the rotation axis and they are mutually parallel to each other.

Each one of the brackets 328 and 330 is coupled with internal space 326 through an internal side opening—332, 334 (respectively) that is directed towards internal space 326 and coupled with it (side internal space 324 is not shown at the specific cross section that constitutes drawing 3).

Further more, each of the two brackets 328 and 330 is constructed with an external side opening 336 and 338, respectively, that is essentially parallel to its mate—internal side the opening, and directed to a direction that stretches farther out from the rotation axis 30 (Note: external side opening 338 is not shown in drawings No. 3 and 4).

Mouthpieces—50 and 60 are mounted on brackets 328 and 330, respectively. Each of them—50 and 60—is constructed as a kind of a cylindrical bushing and has a central rotation axis. Across each of these cylindrical bushings that constitutes, as said, mouthpieces 50 and 60, respectively, a nozzle—52 and 62 (respectively) is constructed. In the cross section presented in drawing 3, the whole length of nozzle 52 can be observed. Each one of the two nozzles has its flow inlet 352 and 362, respectively (in drawing No. 4, the flow inlet 362 of mouthpiece 60 can be observed), and similarly, the flow outlets 54 and 64 from it (respectively) are shown (see mouthpiece 50 in drawing No. 4, where the flow outlet 54 can be observed).

The upper end of upper turret component 322 is constructed with upper axial bore passage 342. Around the bore's circumference a stepped recess 343 is formed. Axial bore passage 342 interfaces the inner space 326 and a ring-like sector on the conical surface 344 that is constructed on the outer side of the upper turret component 322, along the circumference of the bore.

A recess 345 (together with several brackets 346) is formed around the circumference of the conical outer surface at the upper end of turret component 322 and at a small distance away from it. Brackets 346 are formed to be coupled with cover component 324.

At its bottom part, upper turret component 322 is constructed with an internal thread 348. The internal thread 348 in the upper turret component 322 is intended to integrate with external thread 350 that is formed on the circumference of lower turret component 324.

Lower turret component 324 is also designed and constructed as housing with an inner space 354, opened at its upper part. A recess 355 is formed along the circumference edge of inner space 354 and a small distance from it. Lower axial bore passage 356 interfaces between the inner space 354 and the outer surface of the lower turret component. Recess 358 is formed around the circumference of the bore.

The rotateable turret assembly 20 includes as well an array of seals—a static seals —circumferential seals (for example, of the O-ring type) 363 and 364, and dynamic ones—seal 366, disc 368 and seal 370. Herein after the function of the seals will be discussed.

Threading the upper turret component 322 unto lower turret component 324 defines an internal space 375 within the rotateable turret assembly 20.

Static seal 364 is positioned in recess 355 that is constructed along the circumference of lower turret component 324, so that on installing the upper turret component on the lower turret component the seal seals the coupling made between them.

The viscous braking mechanism 80 includes a rotating dynamic assembly 380 that actually constitutes part of the rotateable turret assembly 20, plus static component 381 and viscous fluid 382 (for example silicone oil).

Static component 381 constitutes actually part of the base component 40. Static component 381 is partly constructed as a pin 383 that, on its one side a conic disc 385 is constructed. The disc has a relatively large diameter and surface area in comparison to pin 383 diameter. On the other end of the static component 381, pin 383 is formed with several ribs 387 that protrude along its length and around its circumference. A bore 389 is also found in pin 383.

As can be seen in drawing 3, the conic outer surfaces 385 of static component 381 match in their shape the conic surfaces 344 that are formed on the outer side of upper turret component.

When static component 381 of the viscous braking mechanism 80 is positioned and installed unto base assembly 40 (by a method to be described below), the conic surfaces 344 formed on the outer side of upper turret component 322 constitute the bottom of basin 388 into which viscous liquid 482 is poured.

The static sealing means 363 is located in recess 382 formed at the top end of upper turret component 322. After filling the viscous liquid 482, cover component 320 is mounted on the top end of the upper turret component 322. Tabs 401 that are designed around the outer circumference of cover 320, are coupled with brackets 346 formed at the top end of upper turret component to form an "under cut" type of connector 403. Sealing means 363 seals their mutual coupling line forming a seal against viscous liquid 482 leaking out. Sealing means 363 seals said connection to prevent the viscous fluid 482 filling basin 383 from leaking out through the connection area between them, and in addition said seal will prevent contaminating materials from entering.

The lower side of cover 320, the one facing in the assembly towards a sector of the conic outer surface 344 that is formed on the outer side of upper turret component 322, is formed with a sector of matching conic outer surface 405. On assembling the cover to the upper turret component, the conic outer surfaces of the cover defined a small gap with the conic outer surface of the upper turret component.

By this manner the revolving dynamic component 380 of viscous braking mechanism 80 is formed—a combination of conic outer surface 344 that are formed on the outer side of the upper turret component 322 with the matching outer surface 405 that are formed on the lower side of the cover component 320, which upon assembling, are positioned at a given spacing gap from it. Upon closing the cover, the conic outer surface 385 of the static component 381 are positioned in the gap between the cover and the upper turret component. Basin 388 in which viscous liquid 482 is found is bounded in this space that is now defined by the spaces intentionally left between them.

Dynamic sealing means 366 is located in recess 343 formed around the circumference of the upper axial passage bore 342 located in the upper turret component. Disc 368 is also located within recess 343 that is formed around the circumference of the upper axial passage bore, and maintains the positioning of dynamic sealing means 366.

When assembling the sprinkler, the pin portion 383 of static component 381, is inserted through the upper axial passage bore 342. Dynamic sealing means 366 imparts bidirectional sealing, between the water under pressure that will fill the inner space 375 and the viscous liquid 482 of the viscous braking mechanism 80 filling the sealed basin 390 of the viscous braking mechanism and in the opposite direction as well.

In the illustrated example (see drawing 3), dynamic sealing means 366 is a ring shaped seal whose cross section has plurality of ribs. Some of said ribs are coupled to a sealing contact with the circumference of recess 343 that is formed in the upper axial passage bore 342 located in the upper turret component, and some of the ribs connect to form a sealing contact with the outer surface of pin 383.

Base assembly 40 includes as cited the static component 381 of the viscous braking mechanism 80, and also a piston assembly 440 and a cylinder assembly 443.

Piston assembly 440 comprises a hollow tubular component 445 that is formed with an inner conduit means 227. At one end of the hollow tubular component 445 a protruding shoulder is constructed around its circumference. At the other end of the hollow tubular component 445 a bracket 455 is formed.

Bracket 455 is formed with a stepped internal bore 457 (see drawing 3), which is formed along the axis of the hollow tubular component 445. The dimensions of bore 457 are suited to accommodate within it the pin portion 383 of static component 381, and is formed, at its upper end part, with several length wise slots 459 around its circumference (the slots are not seen in drawings 3 and 4). The slots are suited to receive in them the protruding ribs 387 that are formed at the end portion of static component 381.

Piston component 440 also includes coupling means 465 (in the illustrated example—a screw) for installing static component 381 into internal bore 457 of bracket 455 at the time of assembling the sprinkler. The end of screw 465 screws into bore 389 which is formed in the pin portion 383 of static component 381. Screwing screw 465 into static component 381, draws pin 383 into the upper part of bore 457 and ribs 387 formed on pin 383 are drawn into the matching slots that are formed as cited around bore 457 at its upper part. Thus static component 381 of viscous braking mechanism 80 is positioned and connected to the base component 40 in a manner that fix and prevents the rotation of static component 381 relative to it.

Several side openings 461, kind of "windows", are formed around the circumference of hollow tubular component 445 and connect between its inner part—an inner conduit means 447 to its external surface.

In the sector situated between "windows" 461 and the protruding shoulder 450, several ribs 463 are formed, wherein they protrude outwards from the outer surface of the tubular component, and stretch in a direction parallel to its axis.

Cylindrical component 443, is formed with an external thread 41 on its outer circumference in a manner that enables the attaching of the sprinkler to an anchoring means (that is not illustrated), for example to an adapter that is installed on its side, on a peg, and together they constitute part of a means for conveying water under pressure into the sprinkler. Rings 473 protrude above thread 41. Rings 473 are formed on their side with surfaces 475 that are all parallel one to the other (see also in drawing 6). Surfaces 475 fit the task of holding a tool that is not illustrated (for example a pliers or adjustable wrench), in a manner that would facilitate the assembly/disassembly of the sprinkler to the anchoring means.

At the time of assembling sprinkler 10, piston assembly 440 of the base assembly 40 is threaded in a linear movement into cylinder component 443 of base assembly 40. A sector of tubular component 445 of the piston assembly 440 is inserted via bottom axial passage bore 356 that is formed in the lower turret component 324.

A second dynamic sealing means 370 is located in recess 358 that is formed in the lower turret component around the lower axial passage bore 356. Dynamic seal 370 seals between inner space 375 located within the rotateable turret assembly 20 and the surroundings. Dynamic seal means 370 is a ring seal that, in the illustrated example, its outer surfaces are connected to a sealing contact with circumferential recess 358 formed in the bottom axial passage bore 356 located at the lower turret component, and its inner surface connect to a sealing contact with the outer surface of tubular component 445.

In the given sprinkler 10 example, the base assembly 440 includes also a no-drain check valve 480. The no-drain check valve components comprise a springy means 481 (in the illustrated example—spiral spring); seals array—seal 483 and disc 485, and a bracket with flow passage assembly 487 that includes bushing 489 and seal 491 (for example—soft elastomer made O-ring). When referring to drawings numbers 7, 8 and 9 we will elaborate on the structure and operational mode of the no-drain check valve.

In its operating state, after the water flow under pressure overcame the no-drain check valve means 480, the water is routed via the inner conduit means 447 towards the rotateable turret assembly 20. The water exit through the side openings 461 formed along tubular component 445, and enters into the inner space 375 formed in rotateable turret assembly 20.

Let's refer to drawing No. 5. This drawing is a cross section illustration of the revolving sprinkler 10 illustrated in drawing 1, along the line marked B-B there, and it is possible to use it for comprehending the route of the water from the instant they emanated from the "windows" and entered into inner space 375.

From the inner space 375 the water pass through side openings 332 and 334 formed in each of the brackets 328 and 330, and then routed into the flow inlets 352, 362 formed in the nozzles of the two mouthpieces 50 and 60, respectively (in the specific illustrated cross section, mouthpiece 60 is somewhat rotated sideways, hence it is not possible to see the whole nozzle).

The water flows through nozzles 52 and 62 and exits the water outlets 54 and 64 of the nozzles as water jets. The water jets pass via the external side openings 336, 338 of the brackets 328 and 330, on their way onwards to the surfaces that are intended to be irrigated (see drawing 1).

The openings—the internal side openings 332 and 334 and the external ones 336, 338 —which are formed in each of the brackets, serve as kind of "windows". In the specific configuration of the drawn sprinkler 10, their height enables making desired changes of the elevation angles of the water flow patterns, the changes of the angle $\alpha$—the elevation angle that was treated earlier when referring to drawings 1 and 2. In other words, the internal and the external side opening are formed with specific height dimension that enable rotation, separately, of each of the mouthpieces in manner that would change the direction of said elevation angle $\alpha$ of the flow outlet in its respective nozzle, and this, without blocking the flow by any obstacle.

The openings are formed so that they extend, eventually, from a zone that is located so that it faces the rotation axis up to a zone that is a given distance away from it. As it was explained above, the height dimension of each of the "windows" is such that it enables said variations in angle $\alpha$ which were discussed in referring to drawings 1 and 2. On the other hand, the width dimension $\Delta L$ of the openings (or, in other words, the width range of the openings) which is easy to estimate by referring to drawing No. 5, enables "universal" positioning of mouthpieces whose "L" values differ one from each other (from the point of view of the terminology we used when referring to drawings 1), and this without causing the flow from the nozzles to be blocked.

In other words, the dimensions of the openings enable to install in the brackets mouthpieces that differ one from each other by the configuration of their nozzles and/or by the physical distances set when installing them in the brackets—distances between the water outlet from their nozzles to the rotation axis of the rotateable turret assembly. We will elaborate on the subject of the structures of the brackets and the mouthpieces installed therein in our discussion referring to drawing 6.

The water jets exiting from the mouthpieces' nozzles generate—as said, reaction forces that bring about the revolving of the rotateable turret assembly 20 around rotation axis 30. If we look back at drawing No. 3, we note that tubular component 445 serves as the bearing surface of lower axial bore passage 356 that is formed in the lower turret component 324. Whereas pin portion 383 of static component 381 serves as the bearing surface for upper axial bore passage 342 that is formed at the upper turret component.

Any professional in this field would conclude that this kind of internal bearings application, in which the rotateable turret assembly 20 practically utilizes bearing surfaces on its two ends over an inner static assembly, while the mouthpieces are located upon said virtual plane that is positioned in the gap between the two "bearings", such a configuration would impart considerable dynamic stability to the sprinkler. However, as said, sprinkler 10 is described only for the sake of providing a tenable example, whereas any professional in this field would understand that it is feasible to implement the present invention when using other kinds of arrangements or devices serving as the bearings. For example—configuration of a rotateable turret assembly wherein external "bridge" structure is utilized for bearing purposes.

The rotation velocity of the rotateable turret assembly 20 is slowed down by said viscous braking mechanism 80. The rotateable turret moves in a circular motion due to the driving force that is formed by the flow of the water from the mouthpieces. On the other hand, static component 381 of the viscous braking mechanism 80 is fixed on the base assembly 40 (in the illustrated example—to bracket 455 of tubular component 445) and does not revolve. The relative motion between the revolving dynamic component 380—the conic outer surfaces 405 and 344 and of the cover component of the upper turret component to the conic outer surfaces 385 of the static component, generate shearing forces in the viscous fluid 482 filling basin 388. These forces oppose the driving moment, slow down the rotation rate of the rotateable turret assembly 20, and hence causes an increase of the sprinkling range of the water jets.

In the revolving sprinkler in accordance with the preferred embodiment of the invention whose components are presented in the drawing, sprinkler 10, and let it be emphasized once more—this is only an example, the braking mechanism 80 that is presented, also as an example, is of the viscous braking mechanism type. But, any professional in this field would understand that the present invention can be implemented also by using other braking mechanisms, such as, for example, a mechanism employing toothed wheels.

As cited, the capability to exchange mouthpieces, one or more, in a revolving sprinkler, is a fundamental for the current invention. It enables a variety of throughputs—distance relations, and all this without changing the rotation velocity of the rotateable turret assembly. Namely—to maintain the revolving velocity of the rotateable turret assembly essentially constant, and this, whether—as said, one mouthpiece or more is/are installed in the rotateable turret assembly, which suits one throughput value, or if a mouthpiece adapted to a different throughput value is installed.

Figure 6A:
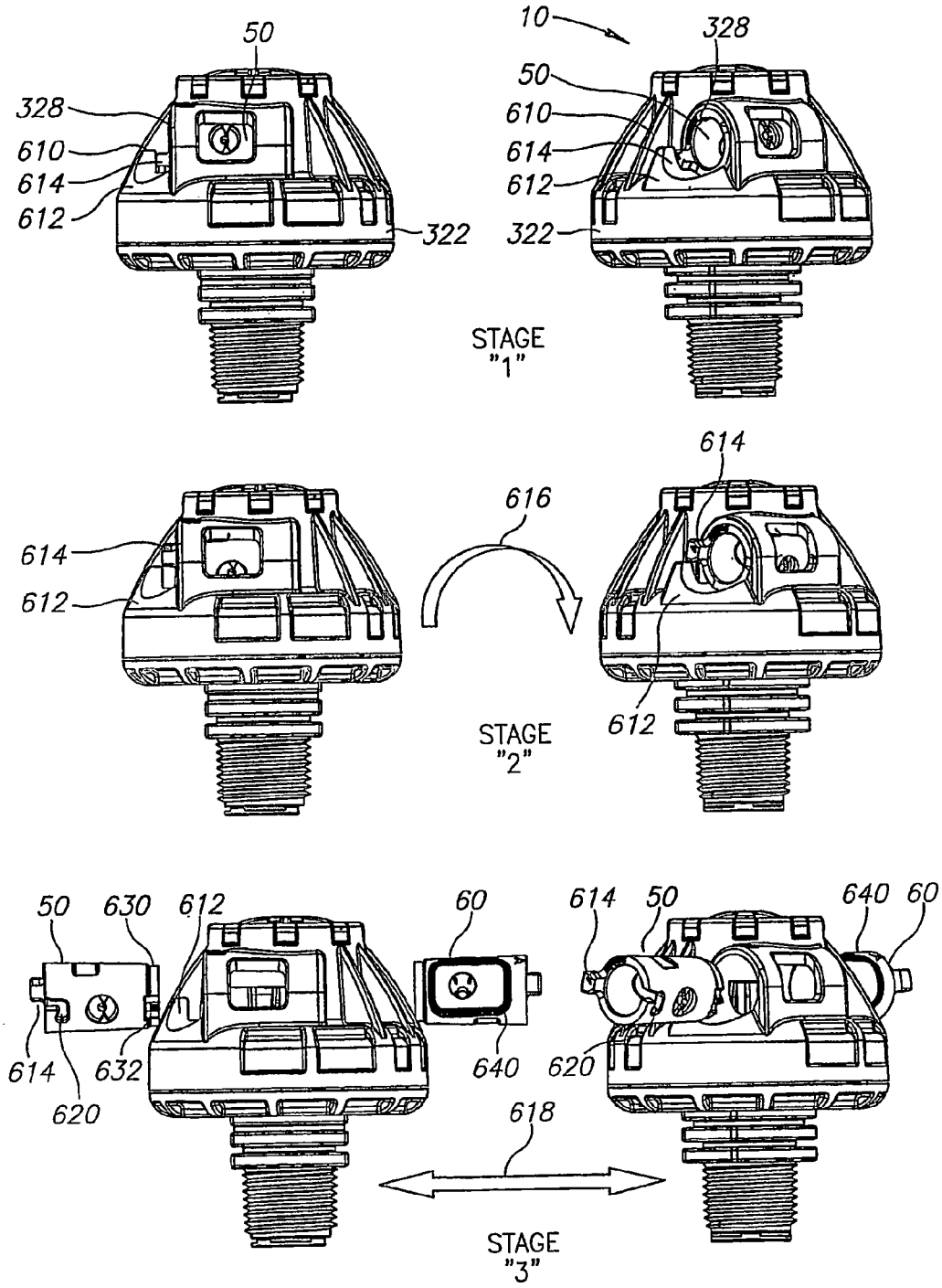
Figure 6B:
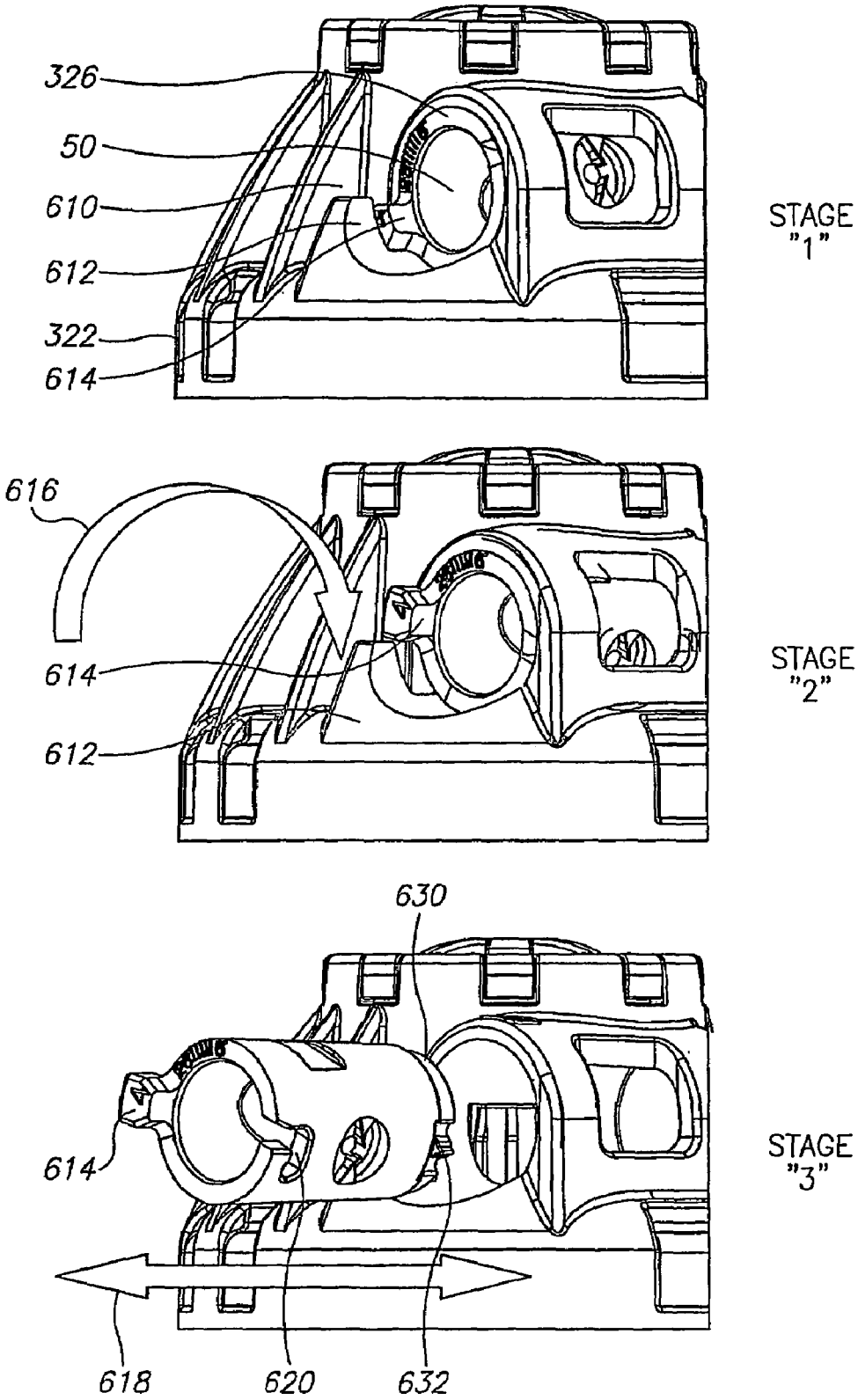
Figure 7:
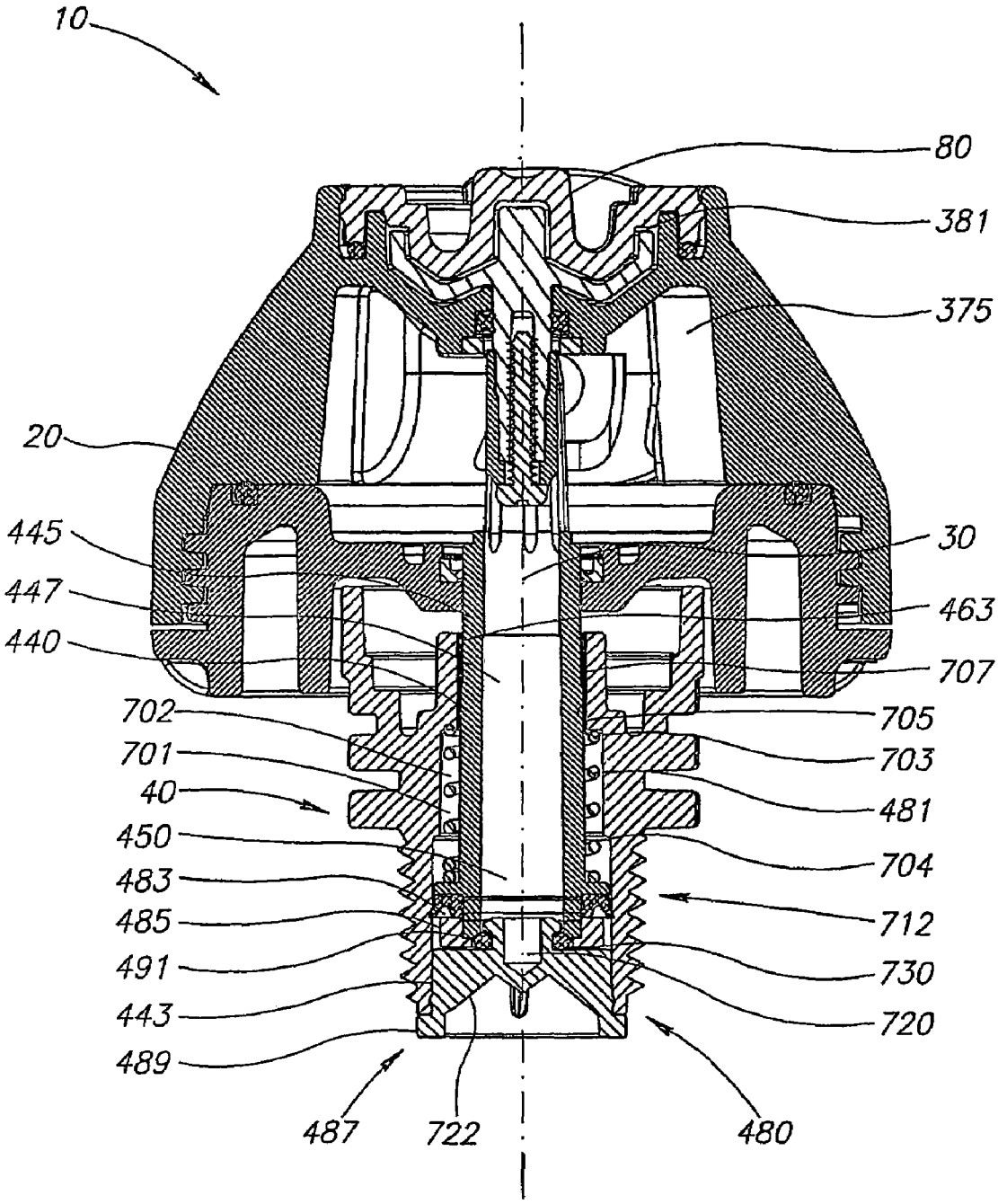
Figure 8:
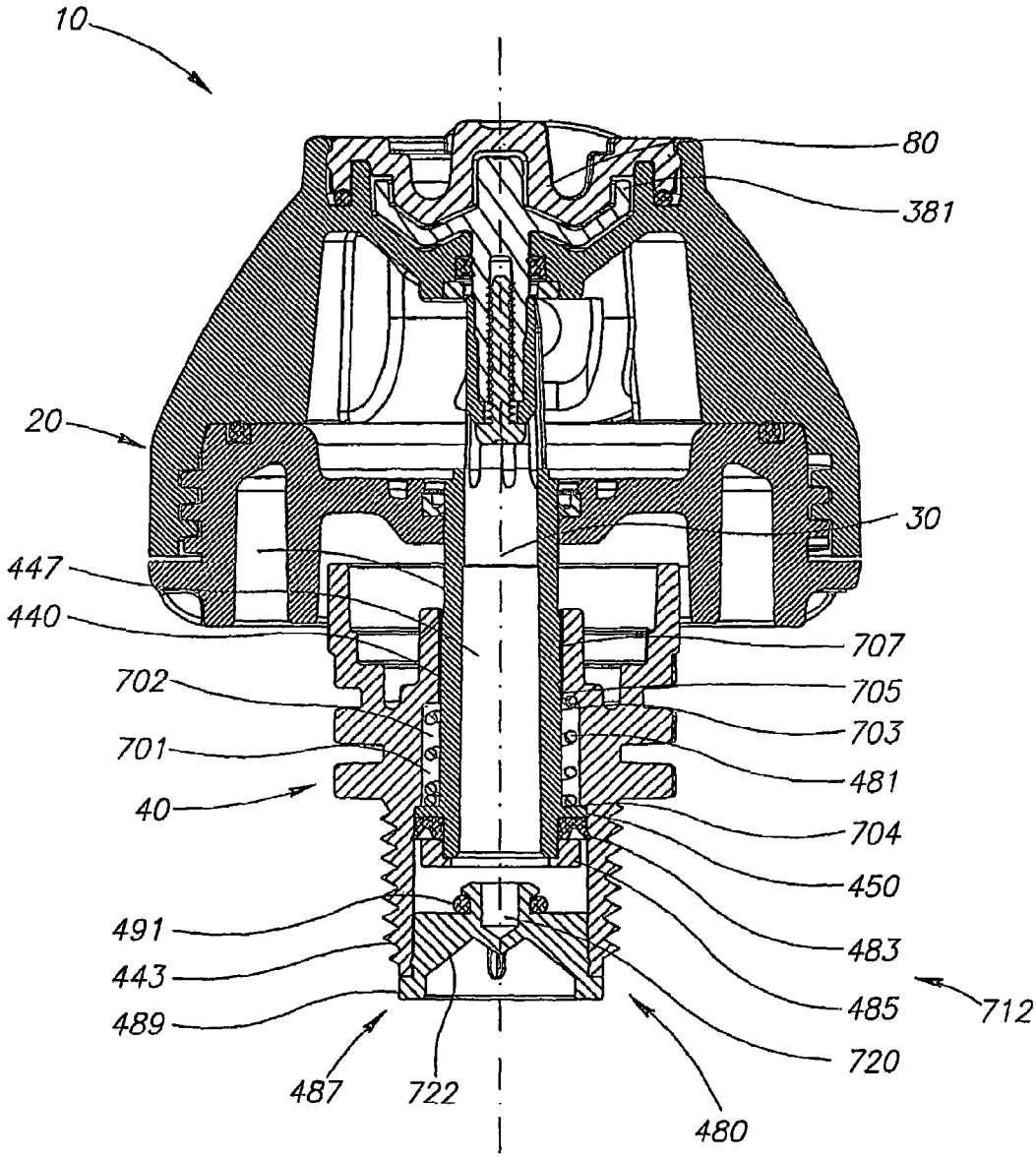
Figure 9:
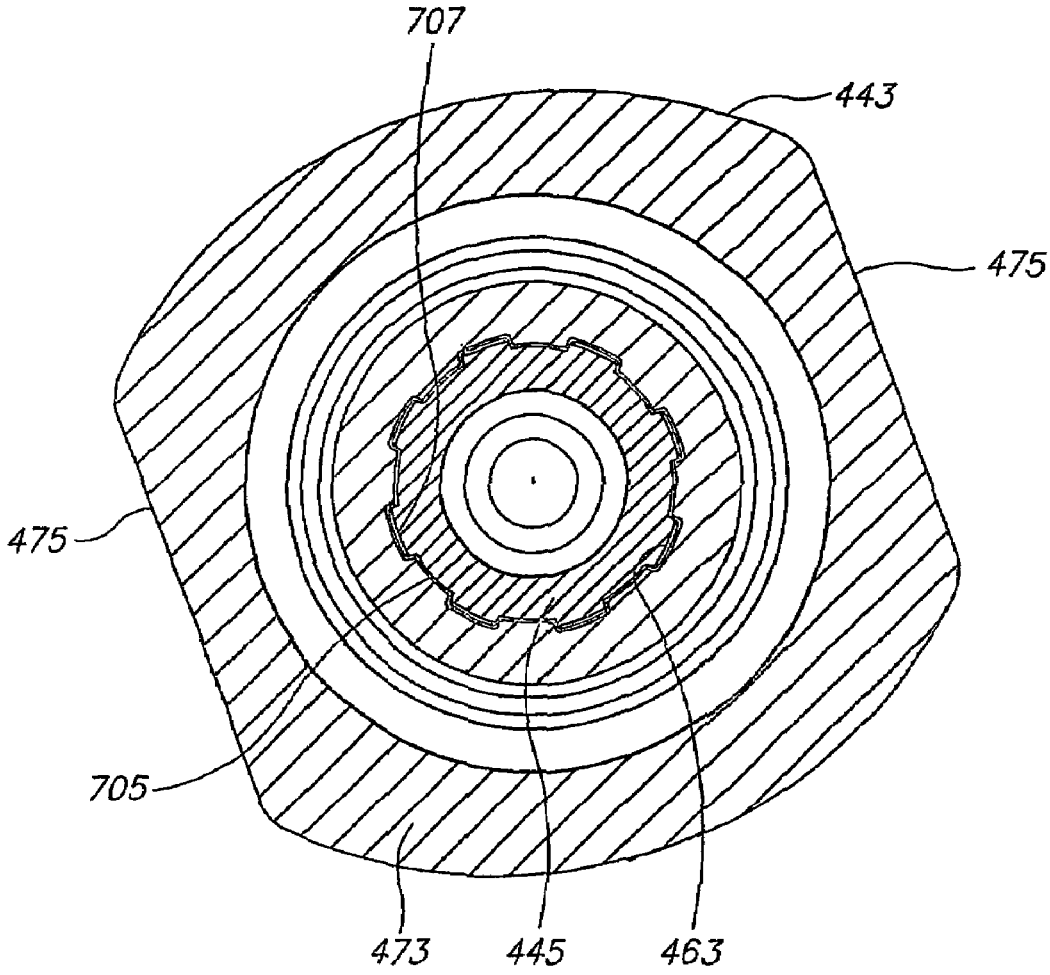
Figure 10:
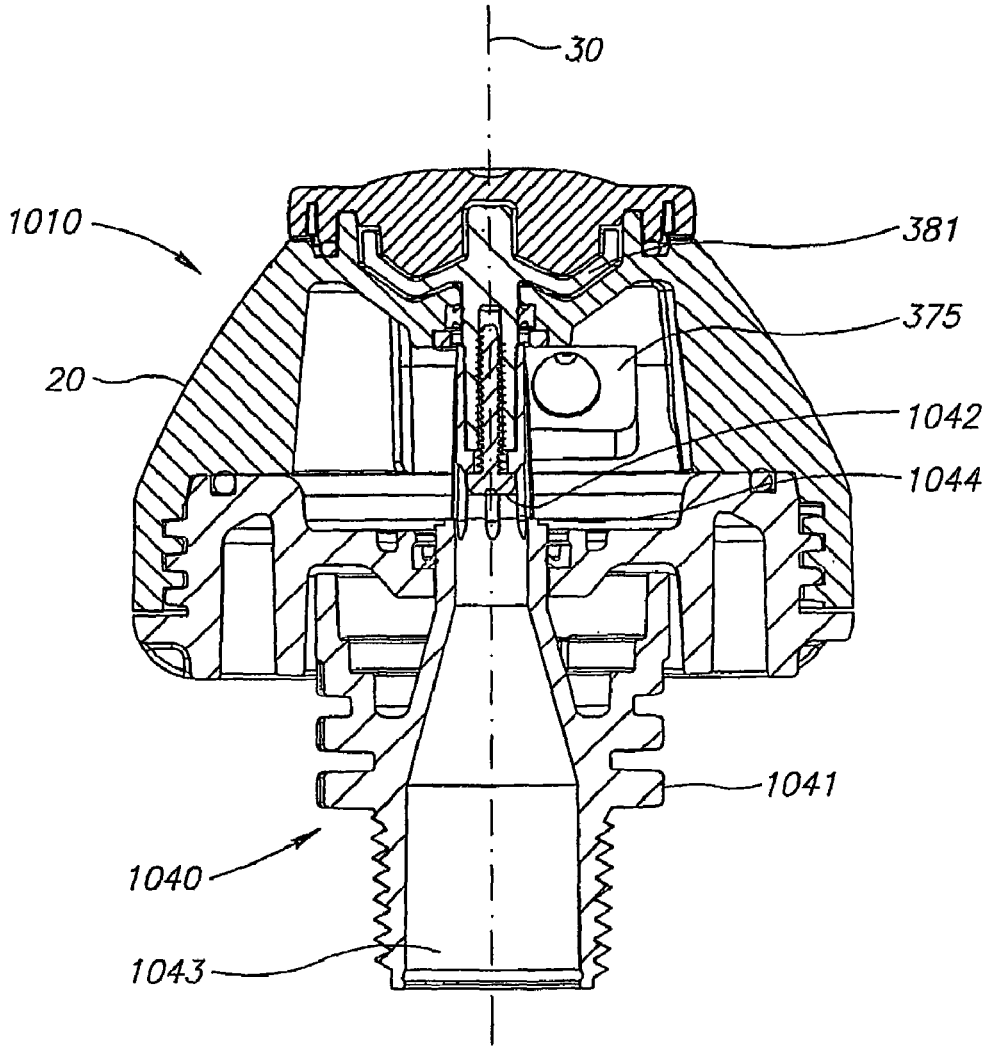
Figure 11:
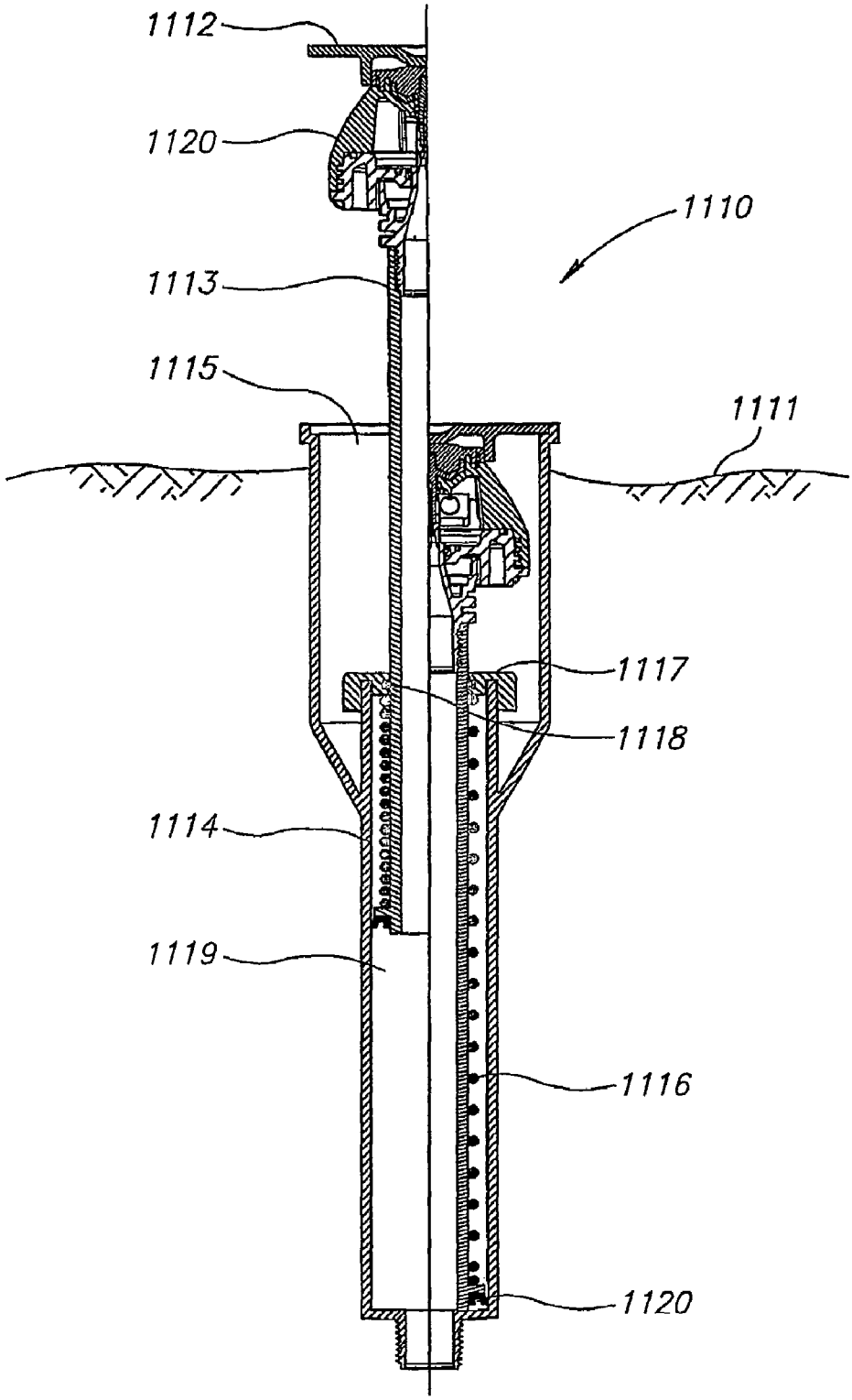

Let's refer now to drawing No. 6 (the drawing comprises two consecutive sheets, 6A and 6B). One (FIG. 6A) describes by a view from a distance (from two angles) the dismantling and assembly of a mouthpiece of a revolving sprinkler 10 that was described in drawings 1 to 5; the other (FIG. 6B) describes the same procedure by a close up view (from a single angle).

In stage "1" mouthpiece 50 is illustrated as it is located within bracket 328, and this after it was inserted into it in a linear movement along the bore formed in the bracket.

On its insertion, mouthpiece 50 engagement with bracket 328 formed a "bayonet" type of connector 610. On the outer surface of the upper turret component 322, and a short distance from the entrance to bracket 328, a protruding shoulder 612 is formed. On the opposite side, mouthpiece 50 is formed with a projection 614 at its rear side. After inserting the mouthpiece to the bracket in a linear movement along the bore in the bracket, and slightly rotating the cylindrical mouthpiece around itself, projection 614 is coupled into the gap between the protruding shoulder 612 and the entrance to bracket 328.

Connector 610 prevents the outward extraction of the mouthpiece, while protruding shoulder 612 imparts on the cylindrical mouthpiece a range for turning around itself, in order to adjust the elevation angle $\alpha$ (and see above, with references to drawings 1 to 5).

Moreover, any professional in this field would understand that it is possible to impart, to each of the mouthpieces, the capability of being rotateable by approximately 180° within the bracket in which it is situated. Thus, in one state, the nozzle's inlet is found facing the internal side opening of the bracket, whereas the outlet is found opposite the external side opening of the bracket (see for example—mouthpiece 50 that is illustrated in drawings 5 and 6). In the other state (which is not illustrated), after the mouthpiece is rotated by approximately 180°, the flow outlet is found facing the internal side opening of the bracket, whereas the flow inlet of the nozzle is found opposite the external side opening of the bracket. Thus it is possible, periodically, to turn the flow outlet of the nozzle directly towards the flow of the water under pressure that emanates from the inner space in order to flush the nozzle.

If we revert to drawing 6, in stage "2" mouthpiece 50 was turned around itself as a first stage in the procedure for replacing it (see arrow 616). The rotation of the mouthpiece pushes projection 614 to beyond the range that shoulder 610 imparts.

In stage "3" the mouthpiece is extracted (or inserted) by a linear movement (see arrow 618). Turning the mouthpiece and its subsequent extraction might be done using a tool (not illustrated)—for example a screwdriver or a special wrench. The mouthpiece is formed with a slot 620 that serves as a basis for handling the tools. In the distant view of stage 3, the extraction of the mouthpiece 60 from the other side can be seen.

Drawing No. 6 presents a close up view of two additional structural aspects that are implemented in the preferred configuration of sprinkler 10, in all that is relevant to mouthpieces 50 and 60

The specific interface between said mouthpieces and the brackets, imparts to the user a sensual indication—and as an option also a sonic indication (explained later), at the time that changes are made of the mouthpieces' elevation angle (the angle $\alpha$ which we discussed earlier while referring drawings 1 to 5). On observing mouthpiece 50 as it is illustrated in stage 3, at the leading edge of the mouthpieces that is inserted first into bracket 328, it is possible to discern a step 630. Around said step 630 two bulges 632 are formed. Facing them, on the inner circumference of bracket 328, on the surface of the bracket that engaged with the leading edge of the mouthpiece, upon inserting it into the bracket, a ring sector with matching protrusions is formed (not illustrated). The assembly of the mouthpiece in the bracket couples bulges 632 with the protrusions within the brackets (that are not illustrated). Now, rotating mouthpiece 50 around itself would bring about skipping ("jumping") by bulges 632 over the protrusions formed within the bracket—and this forms the sense of feeling a "click", which might—optionally, be accompanied by the same sonic effect.

The second structural aspect is the matter of ensuring the sealing of the edges of the inner "windows" 332, 334. These inner openings connect, as cited, brackets 328 and 330 to internal space 375 formed in the rotateable turret assembly 20, and made to route the water under pressure into the flow inlets of the nozzles (see drawings 4 and 5).

Sealing of the openings edges might be required, due to the fact that when installing the mouthpieces into the brackets, the water under pressure filling internal space 375 might leak via the interface between the outer surfaces of the mouthpiece and the inner surfaces of the bracket in which it was installed.

As can be observed in drawing 6 A, at stage "3" (and also in drawing 4—see mouthpiece 60 there), an integral sealing means 640 is implemented in the structure of the mouthpieces. Seal 640 is formed so that it protrudes above the outer surface of the mouthpiece, around the circumference of the flow inlet to the nozzle, and at some distance away from it. At the time of installing the mouthpiece inside the bracket, seal 640 seals the circumference of the side opening formed in the bracket, and routes the water under pressure from the inner space formed in the rotateable turret assembly unto the flow inlet that is formed at the mouthpiece's nozzle. Any professional in this field would understand, that the seal's pattern around the flow inlet, has to continue and seal the edges of the inner side opening in case that the mouthpiece is subjected to angular adjustments (of angle $\alpha$).

The mouthpiece itself, might be manufactured from a plastic material with elastomeric properties, e. g., EPDM, Santofran, polyurethane. The elastomeric material contributes as well to the sealing of the mouthpiece within the bracket, and also withstands well, abrasion caused over time by water flow.

Let's refer to drawings 7 and 8. Drawing No. 7 is an additional side cross section of revolving sprinkler 10 illustrated in drawing 2, along the line marked C-C therein, wherein the no-drain check valve means 480 that is embedded in the preferred configuration of sprinkler 10 is in the "closed" state (no drain state). Drawing 8 is a side cross section view of the revolving sprinklers illustrated in drawing 7, wherein the no-drain check valve means 480 is in the "open" state.

The no-drain check valve means 480 is actually a "normally closed" type valve. Base assembly 40 constitutes also an integral no-drain check valve. Preventing drain of the water through the sprinkler, when the liquid flow pressure decreases (another preferred embodiment of a sprinkler in accordance with the present invention that does not include no-drain check valve is presented in drawing No. 10).

As explained above (while relating to drawings 3 and 4), base assembly 40 comprises piston assembly 40 in which inner conduit means 447 is incorporated, for routing the water under pressure into inner space 375 of the turret assembly 20. In order to impart no-drain capability to sprinkler 10, piston assembly 440 has linear movement capability together with the rotateable turret assembly 20 along the rotation axis 30. The linear motion of the piston assembly 440 is performed relative to cylinder component 443 which is also a part of base assembly 40 (see and compare drawing 7 to drawing 8).

Cylinder component 443 is formed as a tubular component formed with an inner space 701 in it. Space 701 is suited by its dimensions to contain in it piston assembly 440 while serving as bearing for the linear motion of the piston assembly, concurrently with allowing a cylindrical space 702 between it and piston assembly 440. Springy means 481 (in the illustrated example—a spiral spring) is located in said cylindrical space 702 existing between piston assembly 440 and cylinder component 443. On one end, the spring rests on inner shoulder 703 that is formed inside cylinder component 443; on its other end the spring rests on protruding shoulder 450 (that, in the illustrated example, is formed in the tubular component 445 and is a part of the piston assembly). In the normal state, spring 481 biasing piston assembly 440 to move in a linear downwards motion, towards the lower end of cylinder component 443. Inner space 701 is formed with a circumferential shoulder 704 and ends with a second circumferential shoulder 703, on which, as said, the end of spring 481 rests.

Passage bore 705 leads from inner space 701 to outside of cylinder component 443. Passage bore 705 is formed with an array of slots 707. Said slots 707 are recessed at the internal surfaces of passage bore 705. The slots extend in a direction that is parallel to the cylinder component axis, and are suited in their dimensions to accommodate ribs 463 that protrude from tubular component 445 of cylinder assembly 440. This, in order to serve as bearings for piston assembly 440 for its linear motion inside cylinder component 443. Let's refer now to drawing No. 9. This is an enlarged cross section view of revolving sprinkler 10 illustrated in drawing 1, along the line marked D—D there. It is possible to observe the manner in which ribs 463 that protrude from tubular component 445 of the cylinder assembly 440, are accommodate within slots array 707 recessed into the inner surface of passage bore 705.

Let's revert to drawings No. 7 and No. 8. Base assembly 40 comprises in addition (to elements cited earlier), a bracket assembly with flow passage 487 that is affixed to the lower end of cylinder component 443. Bracket assembly 487 includes, in the illustrated example, a bushing component 489 that is affixed to the end of the cylinder component. The bushing is formed with a central part 720. Several radial ribs 722 connect the central part to the circumference of the bushing. Therefore, several flow passages exist among the radial ribs (the flow passages among the radial ribs are seen very clearly in the specific cross section that is presented in drawing 3). Seal 491 is installed around the circumference of the central part of the bushing. Seal 491 is suited in its dimensions as well its flexibility to positioning piston assembly 440 on it, in a manner that prevents passage of fluid from the flow passages to internal conduit means 447. In the illustrated example, seal 491 consists of a rather soft elastomeric O-ring engageable by the entrance edge 730 into the inner conduit means 447. Tubular component 445 is formed, as said, with a protruding shoulder 450 around its circumference. On one side, protruding shoulder 450 serves, as said, for positioning spring 481 on its back. On the other side, shoulder 450 engaged by sealing means 712. Sealing means 712 serves to seal cylindrical space 701. In the illustrated example, sealing means 712 comprises seal 483 and disc 485.

The water, arriving under pressure, pass through the flow passages formed around the central part 720 of bushing 489. The water exerts pressure on seal means 712. The seal means, on its other side, is biased downwards by the force of spring 461 and is positioned on the edge of bushing 489. Simultaneously, spring 481 is biasing in the downward direction also tubular component 445. O-ring 491, on which inlet edge 730 that leads into tubular component is resting, prevents at this stage, the passage of water into inner conduit means 447.

Starting at a pressure threshold that can be pre-set (e.g.—by adjusting spring 481 properties), the force of the water overcomes the force of the spring. As can be seen in drawing 8, the inlet edge strays away upwards in a linear motion, and becomes detached from O-ring 491. Thus entry of water into the inner flow conduit means 447 is enabled.

Entry of water into the inner flow conduit means 447 manages to instantly increase the area exposed to the water pressure. Now we no longer consider the activity of the water pressure on just a small area (that of the bottom of sealing means 712 and edge of inlet 730). The area increase increases the force that pushes and drives tubular component 445 to perform a linear movement upwards, relative to the cylinder component 443 that remains in its place (for example, anchored unto a peg). Tubular component 445 moves in the upward direction in a linear motion taken place within and along slots 707. In its motion, tubular component 445, unto which static component 381 of the viscous braking means 380 is affixed all the time, pushes upwards also the rotateable turret assembly 20. The passage of water between the inlet edge 730 to O-ring seal 491 that was left far behind increases steadily (until the protruding shoulder of the tubular component bumps into circumferential shoulder 704). The passage that was opened enables free flow.

The water flow through side opening 461 formed in the tubular component, into the inner space 375 formed within rotateable turret assembly 20, and whence via the inner "windows" (see drawing 5) into the mouthpieces nozzles. From there—via the external "windows", towards the irrigated area (while driving the rotateable turret assembly 20 to revolve around its axis 30).

When the water source is closed and the pressure diminishes, then—starting at said pressure threshold; the force of spring 481 overcomes on the force exerted by the water. The inlet edge 730 of tubular component 445 will return to move linearly downwards in the direction of O-ring seal 491. Simultaneously, spring 481 would once again biased sealing means 712 towards bushing 489. In this manner sprinkler 10 would revert to the state illustrated in drawing No. 7, namely its "normally closed" state that prevents continued flow or draining of the water through the sprinkler.

The incorporating of a no-drain check valve integrally in a sprinkler constructed in accordance with the present invention is only optional. Any professional in this field would understand that the no-drain check valve can be introduced separately, and that the mere introducing of the no-drain check valve in line with the sprinkler is optional per-se.

Let's refer now to drawing No. 10. The drawing illustrate side cross section view of an additional preferred configuration 1010 in accordance with the present invention, of a revolving sprinkler without the no-drain means.

Similarly to base assembly 40 in sprinkler 10's configuration that included the no-drain check valve means, in sprinkler 1010 as well the base assembly 1940 serves as the bearings of rotateable turret assembly 20 mounted on it. But, in contra distinction to sprinkler 10, in sprinkler 1010 the linear motion along rotation axis 30 does not exist—base assembly 1040 of sprinkler 1010 is basically an integral single part. Base assembly 1040 includes cylindrical component 1041 and coupling means 1042 (a screw in the illustrated example) for installing the static component 381 of the viscous braking mechanism on it. By being formed as an integral single part, cylindrical component 1041 practically integrates (into one) what were the separate tubular component and cylindrical component as they existed in sprinkler 10 (the sprinkler with the integral no-drain check valve means).

In operation, the flow of water under pressure passes through conduit means 1043 formed in the cylindrical component 1041. The water continues its flow and exit via side "windows" 1044 formed in the cylindrical component into the inner space formed in the rotateable turret assembly. From there onwards—via an external "window" (not shown in drawing) towards the area intended to be irrigated (while driving the rotateable turret assembly around its axis).

Any professional in this field would understand that the invention is applicable and can be implemented in many configurations of revolving sprinklers. Thus for example, if referring to drawing No. 11, the drawing is a side cross section view of another preferred configuration—1110, in accordance with present invention—a revolving sprinkler incorporating a pop-up mechanism.

The drawing show (by half cross section view) the sprinkler in its operating state, wherein the pop up means uprights the rotateable turret assembly 1120 to operating state over the surface 1111, and this concurrently with the water pressure increase. In the other half of the cross section view, the sprinkler is illustrated in the Convergence State of the rotateable turret assembly to storage under the ground surface concurrently with the decrease of the water pressure.

The sprinkler shown in the drawing with the pop up mechanism is similar to the one described above (referring to drawing 10), namely a sprinkler devoid of no-drain check valve means. However, any professional in this field would understand that it is possible to incorporate a no-drain check valve means also in a sprinkler in accordance with the invention that is equipped with a pop up mechanism.

In the illustrated example, a wide brim cover 1112 is mounted over the sprinkler's cover, serving to cover the sprinkler during periods in which the rotateable turret assembly is in the converged state for storage under the ground. The base assembly of the sprinkler is installed at the top of tubular piston component 1113. The tubular piston component is positioned for linear motion within a cylinder component 1114. The cylinder component is amenable to be buried in the ground, so that only its upper opening 1115 breaks out above the ground. Spring 1116 is located within cylinder component 1114, one end of the spring rests on the under side of cover 1117. The cover is formed with a passage enabling opening 1118 through which piston component 1113 moves in a linear motion. The other end of spring 1116 rests on a shoulder 1119 that protrudes around the circumference of piston component 1113 near to its other end. Spring 1116 bias tubular piston component 1113 downwards. Seal 1120 prevent passage of water into the space in which spring 1116 is located.

As the water pressure in the tube (not illustrated) increases, the water flows via cylinder component 1114 into the sprinkler's base component, and whence—by a manner already described above in reference to drawing No. 10, to the inner space of the rotateable turret assembly and outwards via the nozzles of the mouthpieces. The water pressure increase exerts a force against spring 1116, and brings about a movement of tubular piston 1113, and with it the base assembly and the rotateable turret assembly that are carried by it, outwards to over the area's surface. When the pressure diminishes the force of the spring bias and moves the tubular piston component to move downwards—to said Convergence State of the sprinkler and closing the cover 1112 on the cylinder component.

Any professional in this field would understand that the pop up structure described above in referring to drawing 11, is given solely as an example and is given to implementation also by other and various pop up mechanisms.

In the same way, a sprinkler in accordance with the present invention, might incorporate in its structure also other and additional mechanisms.

For example—pressure compensating means for regulating variations in the water line pressure while the water flow approach the rotateable turret assembly. A sprinkler in accordance with the present invention might also be adapted for installation in an up side down configuration (for example—installation along a self-propelled irrigation line). In any case, in such configuration, using the language of directions upwards/downwards in the descriptions provided above, is really subject to mutatis mutandis variations that are imposed by said upside down arrangement.

It will be appreciated by persons who are skilled in the art, that the present invention is not limited by what has been particularly shown and described above. Rather, the scope of the present invention is only defmed by the claims that follow.

The invention claimed is:

1. A revolving sprinkler that comprises:

a rotatable turret assembly rotatable around a rotation axis, wherein said assembly is adapted to receive a flow of a liquid under pressure, a first mouthpiece for mounting in said assembly to sprinkle said liquid at a first predetermined throughput at a given liquid pressure;

said mouthpiece including a nozzle having a flow outlet located at a first moment arm linear distance from said rotation axis, and wherein liquid exiting the nozzle imparts to said assembly a driving moment that causes rotation of the turret assembly around said rotation axis; and a base assembly that serves as a bearing for rotation of said rotatable turret assembly around said axis and routes said flow of liquid under pressure to said turret assembly; and a second mouthpiece, for replacing said first mouthpiece, the second mouthpiece sprinkles said liquid at a second predetermined throughput at the given pressure, the second mouthpiece including a nozzle having a flow outlet located at a second moment arm linear distance from said rotation axis when the second mouthpiece is mounted in said turret assembly in place of said first mouthpiece, said second throughput being different from the first throughput and said second distance being different than said first distance; and wherein, said second distance is such that after replacing said first mouthpiece by said second mouthpiece, the driving moment that causes the rotation of said turret assembly remains essentially equal to the driving moment generated when said first mouthpiece was mounted in the assembly.

2. A revolving sprinkler in accordance with claim 1, wherein said first throughput comprises a relatively large throughput, said second throughput comprises a smaller throughput, and said first linear distance is smaller than the second linear distance.

3. A revolving sprinkler in accordance with claim 1, further comprising a third mouthpiece mounted along with said first mouthpiece in said assembly, each one on a different side of said rotation axis and directions of liquid jets exiting from the first and third mouthpieces being essentially in opposition one to the other.

4. A revolving sprinkler in accordance with claim 1, wherein the nozzle of said first mouthpiece includes a flow inlet to be coupled to said flow of liquid under pressure and a flow outlet, and said first mouthpiece is rotatable around a second axis enabling adjustment of an elevation angle of liquid exiting the flow outlet.

5. A revolving sprinkler in accordance with claim 4, wherein said first mouthpiece is rotatable around said second axis by approximately 180° providing for occasional turn of said flow outlet directly to the flow of said liquid under pressure, for flushing said nozzle.

6. A revolving sprinkler in accordance with claim 1, further comprising:

a braking mechanism that is coupled to said rotatable turret assembly for reducing rotation velocity of said turret assembly.

7. A revolving sprinkler in accordance with claim 6, wherein said braking mechanism comprises a viscous damping mechanism, that comprises:

a revolving dynamic assembly that constitutes a part of said rotatable turret assembly;

a static component that is located in relative proximity to said revolving dynamic component, said static component and said dynamic component together demarcate a sealed basin; and a viscous liquid that fills said demarcated basin and opposes movement of said dynamic assembly relative to said static component.

8. A revolving sprinkler in accordance with claim 1, wherein said base assembly comprises:

a no-drain check valve means for preventing drainage of the liquid via said sprinkler when the pressure decreases.

9. A revolving sprinkler in accordance with claim 1, wherein said base assembly further comprises:

a cylinder component adapted to be connected to means for conveying said liquid flow under pressure, said cylinder component including an internal flow conduit means for routing said flow of said liquid under pressure to said rotatable turret assembly.

10. A revolving sprinkler in accordance with claim 1, further comprising:

pop up means for up-righting said rotatable turret assembly to an operating position above a ground surface upon a rise in pressure of said liquid, and for convergence of said rotatable turret assembly to a storage state under the ground surface when said pressure drops.

11. A method for maintaining essentially constant a rotation velocity of a revolving sprinkler even under large throughput variations, the method comprising:

providing a turret assembly rotatable around an axis, said assembly being adapted to be coupled to a flow of a liquid, providing a first mouthpiece for mounting in said assembly to sprinkle said liquid under pressure at a first preset throughput at a given liquid pressure, said mouthpiece including a nozzle having a flow outlet located at a first moment arm linear distance from said axis of said assembly so that flow of liquid from the nozzle of said mouthpiece imparts on said assembly a driving moment causing assembly rotation; and providing a base assembly that serves as a bearing for rotation of said rotatable turret assembly around said axis and routes said flow of liquid to said turret assembly; and providing a second mouthpiece for selectively replacing said first mouthpiece, said second mouthpiece having a second throughput at the given liquid pressure different than said first throughput, and including a nozzle having a flow outlet located at a second moment arm linear distance from said axis different than said first moment arm linear distance, such that, after said first mouthpiece is replaced by said second mouthpiece, said driving moment causing the rotation of said rotatable turret assembly around the axis remains essentially equal to the driving moment generated when said first mouthpiece was mounted in said assembly.

12. A method for maintaining a rotation velocity of said sprinkler essentially constant in accordance with claim 11, further comprising:

providing a braking mechanism coupled to said rotatable turret assembly for slowing down the rotation velocity in accordance with said driving moment.

13. A revolving sprinkler comprising:

a turret assembly rotatable around a rotation axis, said assembly having an inner space that can be coupled to a flow of liquid under pressure, and two brackets that are essentially located in a plane perpendicular to said rotation axis, wherein each of said brackets is positioned on a respective opposing side of said rotation axis and the brackets are mutually parallel and coupled to flow of liquid from said inner space; and said rotatable turret assembly further comprises:

two mouthpieces each adapted to be installed at a respective bracket of said brackets, each mouthpiece having a nozzle having a flow inlet and a flow outlet and, wherein after installing each of said mouthpieces at the respective bracket, the flow outlet of the nozzle of a first mouthpiece of said two mouthpieces points in a direction essentially opposite to the flow outlet of the nozzle of a second mouthpiece of said two mouthpieces, and said flow outlets are situated at given moment arm linear distances from said rotation axis of said rotatable turret assembly, and said flow inlets of said nozzles are coupled to the flow of said liquid under pressure; and said revolving sprinkler further comprises:

a static base assembly that serves as a bearing for rotating said rotatable turret assembly around said axis; and said base assembly has an internal conduit for routing said flow of said liquid under pressure into said inner space of said turret assembly, and whence, via said brackets, to said nozzles of said two mouthpieces, and from the nozzle flow outlets, outwards, so that outwards flow of said liquid from said flow outlets of said nozzles, impart to said turret assembly a driving moment that causes assembly rotation relative to said base assembly; and said revolving sprinkler further comprises:

a viscous damping mechanism coupled to said rotatable turret assembly for slowing down rotation velocity of the assembly, the mechanism including:

a revolving dynamic component that constitutes a part of said rotatable turret assembly;

a static component affixed to said base assembly and located in relative proximity to said revolving dynamic component, said static component together with the revolving dynamic component demarcate a sealed basin; and a viscous fluid filling said sealed basin which opposes motion of said revolving dynamic assembly relative to said static component; and wherein at least one mouthpiece of said two mouthpieces is adapted to be dismantled from the respective bracket at which said at least one mouthpiece is installed, and further comprising another mouthpiece, that replaces said at least one mouthpiece and differs from said at least one mouthpiece, in throughput of said exiting liquid from a flow outlet at a given liquid pressure, and in moment arm linear distance of said flow outlet from said rotation axis, wherein even after replacing said at least one mouthpiece by said another mouthpiece, said driving moment that brings about the rotation of said turret assembly remains essentially equal to said driving moment generated when said first mouthpiece was mounted in said turret assembly, whereby rotation velocity of said rotatable turret assembly remains essentially constant as an outcome of essentially constant driving moment exerted on the assembly, whether said at least one mouthpiece is installed in said rotatable turret assembly or if rather said another mouthpiece is installed in said rotatable turret assembly.

14. A revolving sprinkler in accordance with claim 13, wherein when said one mouthpiece adapted to be dismantled is suited to a relatively large throughput, and said linear distance is smaller than the linear distance of a replacing mouthpiece suited to a smaller throughput.

15. A revolving sprinkler in accordance with claim 13, wherein said base assembly further comprises:

a piston assembly having an inner conduit for routing said flow of said liquid under pressure into said inner space of said turret assembly, and said piston assembly adapted for linear movement together with said rotatable turret assembly along said rotation axis of said rotatable turret assembly; and said base assembly further comprises:

a cylinder component adapted to be connected to a means for conveying said flow of a liquid under pressure, and dimensioned to include said piston assembly within said cylinder component, while providing a bearing for said linear movement of said piston assembly relative to said cylinder component, concurrently leaving a space between the cylinder component and said piston assembly; and said base assembly further comprises:

a bracket assembly with a flow passage, that is affixed to said cylinder component and enables passage of said liquid under pressure through said flow passage when said piston assembly moves linearly in a direction away from the bracket assembly, and prevents passage of said liquid through the flow passage after said piston assembly moves linearly towards and rests on the bracket assembly; and a spring means that is located in said space between said piston assembly and said cylinder component, wherein one end of the spring means rests on said cylinder component, and an other end rests on said piston assembly and biases said piston assembly to move linearly towards said bracket assembly, when a drop in liquid flow pressure occurs, and said base assembly also includes a no-drain check valve means for preventing drainage of said liquid through said sprinkler when said pressure of said liquid flow decreases.

16. A revolving sprinkler in accordance with claim 15, wherein said piston assembly comprises:

a tubular component, having one end dimensioned to engage said bracket assembly;

the tubular component having a protruding shoulder around a circumference, which serves, on one side, for resting the other end of said spring means on said shoulder, and on an other end couples to sealing means for sealing said space between said piston assembly and said cylinder component, in which said spring means is located;

the other end of said tubular component having a bracket that is receives said static component of said viscous damping mechanism; and said tubular component having along its length at least one side opening, for routing said flow of said liquid under pressure into said inner space of said rotatable turret assembly, and at least one rib that protrudes from an external surface of the tubular component and extends in a direction parallel to said rotation axis, for providing a bearing to said linear movement of said piston within said cylinder component; and said piston assembly further comprises:

coupling means for affixing said static component of said viscous damping mechanism to said bracket of said tubular component.

17. A revolving sprinkler in accordance with claim 16, wherein said cylinder component comprises a tubular component with an inner space to contain said tubular component of said piston assembly and said spring means; and said inner space terminates in a shoulder for receiving the one end of said spring means, and a passage bore from said inner space having at least one slot, recessed in an inner surface of said bore and extending in a direction that is parallel to said rotation axis, to accommodate said protruding rib of said tubular component of said piston assembly, for providing a bearing to said piston assembly for linear movement within said cylinder component.

18. A revolving sprinkler in accordance with claim 16, wherein said coupling means comprises a screw.

19. A revolving sprinkler in accordance with claim 15, wherein said bracket assembly with said flow passage further comprises:

a bushing component affixed to an end of said cylinder component, and formed with a central part, several radial ribs that connect said central part to a circumference of the bushing, the ribs providing flow passages between the ribs; and a seal that is installed around a circumference of said central part and dimensioned for resting said piston assembly on said seal in a manner that prevents passage of liquid from said flow passages to said inner conduit formed in said piston assembly.

20. A revolving sprinkler in accordance with claim 19, wherein said seal is an elastomeric O-ring dimensioned to be loaded by pressing on an edge of an inlet to said inner conduit means.

21. A revolving sprinkler as in claim 13, wherein said base assembly comprises:

a cylindrical component connectable to said means for conveying said liquid flow under pressure, and wherein said inner conduit means for routing said flow of said liquid under pressure to said rotatable turret assembly includes a bore formed along a length of said cylindrical component.

22. A revolving sprinkler in accordance with claim 13, whereby said rotatable turret assembly comprises:

a lower turret component having a lower axial passage bore that connects an external side of said lower turret component with said inner space;

an upper turret component for installation upon said lower turret component, and having at least a part of said inner space within it, said two brackets being on an external surface of said upper turret component, and with a passage bore connecting said inner space with a surface area on an external surface of said upper turret component around a circumference of an upper axial passage bore of said upper turret component; and a cover component mountable on said rotatable turret assembly, and having a matching surface area on a lower side that faces, upon being assembled a surface area on said outer surface of said upper turret component, and said rotatable turret assembly, is mounted on a bearing so that it can rotate around said static component of said viscous damping mechanism, that is positioned in said assembly so that the mechanism passes through said upper axial bore passage of said upper turret component; and said revolving dynamic component of said viscous damping mechanism is constituted by said surface area on said external surface of said upper turret component with said matching surface area of the lower side of said cover component; and said sealed basin containing said viscous fluid that resists the motion of said revolving dynamic component relative to said static component, is defined by spaces left between the static component and the dynamic component when positioning said static component.

23. A revolving sprinkler in accordance with claim 22, wherein said rotatable turret assembly further comprises:

a first dynamic sealing means located around said circumference of said upper axial bore passage in said upper turret component, so that said first dynamic sealing means imparts bi-directional sealing, between said liquid under pressure filling said inner space and said viscous liquid inside said sealed basin of said viscous damping mechanism and vice versa.

24. A revolving sprinkler in accordance with claim 23, wherein said dynamic seal means comprises a circular ring seal having a cross section including multiple ribs, wherein upon installation some of said ribs are connected to seal contact with said circumference of said upper axial bore passage located in said upper turret component and some of said ribs connect in a sealing contact to said static component of said viscous damping mechanism.

25. A revolving sprinkler in accordance with claim 22, wherein said rotatable turret assembly further comprises:

a second dynamic seal means positioned around a circumference of said lower axial bore passage located in said lower turret component, which imparts sealing between said liquid under pressure filling said inner space and surroundings.

26. A revolving sprinkler as in claim 22, wherein said rotatable turret assembly further comprises:

a first static seal means located between said lower turret component and said upper turret component, such that on assembling said upper turret component to said lower turret component said seal means seals a connection boundary between the upper turret component and the lower turret component to prevent outflow of said liquid under pressure from said inner space, via said connection boundary.

27. A revolving sprinkler in accordance with claim 22, wherein said rotatable turret assembly further comprises:

a second static seal means that is located between the upper turret component and said cover component, such that on assembling said cover component to said upper turret component, said second static seal means seals an interface connection between the upper turret component and the cover component to prevent outwards leak of said viscous fluid filling said sealed basin of said viscous damping mechanism and to prevent entrance of contamination from surroundings into said viscous fluid.

28. A revolving sprinkler in accordance with claim 13, wherein said mouthpieces comprise a plastic material with elastomeric properties.

29. A revolving sprinkler in accordance with claim 28, wherein said plastic material is selected from a group that consists of: ethylene propylene diene monomer (EPDM) rubber, and polyurethane.

30. A revolving sprinkler as in claim 13, wherein each of said brackets has an internal side opening facing and connected to said inner space and an external side opening substantially parallel to said internal side opening and directed away from said rotation axis of said assembly.

31. A revolving sprinkler in accordance with claim 30, wherein the internal side opening and external side opening of each of said brackets substantially extend from an area opposite said rotation axis to an area removed from the rotation axis a certain distance, and dimensions of said openings enable to assemble inside said brackets, a variety of different mouthpieces differing one from another by configurations of their nozzles and by said linear distances that are formed when assembled in said brackets, between said water outlet opening of said nozzle and said rotation axis of said rotatable turret assembly.

32. A revolving sprinkler in as in claim 31, wherein each of said mouthpieces has an integral seal that protrudes above an outer surface area, around a circumference of said flow inlet of said nozzle and when said mouthpieces are installed inside said brackets, said seal seals a circumference of said internal side opening formed in said bracket and routes said liquid under pressure from said inner space to said flow inlet of said nozzle of said mouthpieces.

33. A revolving sprinkler as in claim 30, wherein each of said brackets comprises a cylindrical bore having a longitudinal axis that extends in a direction substantially perpendicular to said rotation axis of said assembly; and each of said mouthpieces has a cylindrical bushing dimensioned to be inserted into said cylindrical bore of said brackets by a linear movement along said longitudinal axis, whereby after inserting said cylindrical bushing, said mouthpiece is rotatable around said longitudinal axis.

34. A revolving sprinkler in accordance with claim 33, wherein each mouthpiece integrates on assembly with a respective bracket, through a bayonet type connector, so that after insertion of said mouthpiece into said respective bracket by a linear movement along said longitudinal axis, and slightly turning the mouthpiece around, said connector prevents extraction of said mouthpiece back outwards, while imparting to said mouthpiece a rotation scope around said longitudinal axis for adjusting elevation angle of said flow outlet.

35. A revolving sprinkler according to claim 30, wherein the internal side opening and the external side opening, are dimensioned to enable rotation of at least one of said mouthpieces around said longitudinal axis of a respective bracket in which the at least one is installed, in a manner that changes elevation angle of the flow outlet, without said flow being blocked.

36. A revolving sprinkler accordance to claim 35, wherein said at least one of said mouthpieces is rotatable by approximately 180° around said longitudinal axis of said respective bracket in which said at least one is installed, whereby in one state, said flow inlet of said nozzle of said at least one mouthpiece is set to face said internal side opening of said respective bracket, whereas said flow outlet from said nozzle faces said external side opening; and in a second state, after said at least one mouthpiece is turned by approximately 180° around, said flow outlet of said nozzle of said at least one mouthpiece is set so to face said internal side opening, whereas said flow inlet from said nozzle faces said external side opening enabling to occasionally direct said flow outlet of said nozzle directly to said flow of liquid under pressure, in order to flush said nozzle.

* * * * *